US007018022B2

(12) United States Patent
Kameda et al.

(10) Patent No.: US 7,018,022 B2
(45) Date of Patent: Mar. 28, 2006

(54) INKJET PRINTHEAD AND INKJET IMAGE APPARATUS

(75) Inventors: Takeshi Kameda, Tenri (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/459,553

(22) Filed: Jun. 12, 2003

(65) Prior Publication Data

US 2004/0001121 A1 Jan. 1, 2004

(30) Foreign Application Priority Data

Jun. 12, 2002 (JP) ..... 2002-171673
Jun. 13, 2002 (JP) ..... 2002-173310

(51) Int. Cl.
*B41J 2/045* (2006.01)
*B41J 29/38* (2006.01)

(52) U.S. Cl. ..... 347/68; 347/14

(58) Field of Classification Search ..... 347/10–11, 347/14, 15, 68–72, 74, 17, 5–6, 102, 4
See application file for complete search history.

(56) References Cited

U.S. PATENT DOCUMENTS 5,130,726 A * 7/1992 Fukushima et al. ..... 347/102
5,264,865 A * 11/1993 Shimoda et al. ..... 347/11
5,610,637 A * 3/1997 Sekiya et al. ..... 347/10
5,917,522 A * 6/1999 Takahashi ..... 347/71
6,109,716 A * 8/2000 Takahashi ..... 347/11
6,168,252 B1 * 1/2001 Yaji ..... 347/14
6,467,865 B1 * 10/2002 Iwamura et al. ..... 347/14

FOREIGN PATENT DOCUMENTS

JP 63-247051 A 10/1988
JP 9-48113 A 2/1997
JP 11-170521 A 6/1999

* cited by examiner

*Primary Examiner*—Hai Pham
(74) *Attorney, Agent, or Firm*—Birch, Stewart, Kolasch & Birch, LLP

(57) ABSTRACT

An inkjet printhead and an inkjet image forming apparatus capable of achieving improved ink jetting performance as a result of causing partition(s) partitioning ink chamber(s) of inkjet printhead(s) to be made up of piezoelectric member(s) for which rate(s) of change of electromechanical coupling coefficient(s) with respect to temperature display negative characteristics, or causing partition(s) partitioning ink chamber(s) of inkjet printhead(s) to be made up of piezoelectric member(s) for which rate(s) of change of electromechanical coupling coefficient(s) with respect to temperature display positive characteristics and controlling electrical energy supplied to such piezoelectric member(s) based on image data and ink temperature.

10 Claims, 16 Drawing Sheets

INKJET PRINTHEAD AND INKJET IMAGE APPARATUS

BACKGROUND OF INVENTION (1) Field of Invention

The present invention pertains to an inkjet printhead capable of jetting ink droplets onto recording medium or media (recording paper) to form image(s) and to an inkjet image forming apparatus equipped with such inkjet printhead(s). In particular, the present invention relates to a strategy for achieving improved ink droplet jetting performance through stabilization of jetted ink droplet velocity.

(2) Conventional Art

Inkjet-type image forming apparatuses (hereinafter referred to as "inkjet printers") typically carry out image formation by jetting ink droplets onto the surface of recording paper fed therethrough. That is, processing is carried out to create multivalued representations, binary or higher in number of values, of images to be formed, and prescribed dots are formed on recording paper by carrying out controlled jetting of ink droplets from respective nozzles of an inkjet printhead based on a dot ON/OFF signal obtained as a result of such processing.

Furthermore, various types of mechanisms have been proposed for carrying out such jetting of ink droplets. As disclosed for example at Japanese Patent Application Publication Kokai No. S63-247051 (1988), one such mechanism is of a type wherein pressure for jetting of ink droplets is obtained through employment of a piezoelectric member. More specifically, as shown in FIG. 15, plurality of cavities 102, 102, . . . are formed in base plate 101 comprising ceramic or other such piezoelectric material, partitions 103, 103, . . . partitioning respective cavities 102, 102, . . . being polarized in the direction of the depth of ink chambers 104, which correspond to the spaces at the interior of cavities 102, and drive electrodes 105 being formed at prescribed regions (e.g., the upper halves) of these partitions 103. Furthermore, cover plate 106 is attached over base plate 101 so as to close off the tops of these cavities 102. Note that the foregoing respective cavities 102, 102, . . . are formed by cutting using a diamond blade or the like. Furthermore, drive electrodes 105 are formed by sputtering or the like.

In addition, by separately applying pulsed voltages corresponding to image signal(s) to respective drive electrodes 105, 105, . . . , differences in electric potential are created between respective drive electrodes 105, 105, . . . , causing electric fields perpendicular to the foregoing direction of polarization to be produced. As a result of the piezoelectric shear strain effect which is produced at this time, respective partitions 103, 103, . . . undergo shear deformation. This deformation produces a pressure wave within each such ink chamber d, this pressure being responsible for ink droplet jetting action.

This shear deformation action of partitions 103, 103, . . . is typically such that after applying jetting voltage pulse(s) to prescribed drive electrode(s) 105 so as to actuate partition(s) 103 in a direction such as will cause expansion of ink chamber(s) 104, non-jetting voltage pulse(s) is or are applied to prescribed drive electrode(s) e so as to actuate partition(s) 103 in a direction such as will cause contraction of ink chamber(s) 104. As a result thereof, a pressure wave is made to operate on the ink within each such ink chamber 104 so as to cause jetting of ink droplet(s) from this ink chamber 104 by way of ink nozzle(s), not shown.

Also commonly known in the context of such inkjet printers are multidrop-type image forming operations wherein density gradations are achieved by varying the number of ink droplets delivered per dot on recording paper without changing the size of the ink droplets jetted from respective nozzles (see for example Japanese Patent Application Publication Kokai No. H11-170521 (1999)). With such image forming operations as well, controlled jetting of ink droplets from ink chambers is carried out by controlling voltages applied to respective drive electrodes such as has been described above.

Next, the relationship between ink temperature and the velocity of the jetted ink droplets is described. FIG. 16 shows the change in ink viscosity $\eta$ (cp) as a function of ink temperature (° C.). As shown in this FIG. 16, the viscosity $\eta$ (cp) of ink jetted from an ink nozzle varies widely as a function of ink temperature (° C.). For this reason, the low viscosity $\eta$ of ink at high temperature causes ink droplets to be jetted from ink nozzle(s) at high velocity, and conversely, the high viscosity $\eta$ of ink at low temperature causes ink droplets to be jetted from ink nozzle(s) at low velocity. The velocity of jetted ink droplets thus varies widely as a function of ink temperature, and such variation in velocity may be accompanied by shift in the location at which ink droplets land, creating opportunities for deterioration in image quality. In particular, in a low-temperature worst-case scenario, where ink viscosity $\eta$ becomes markedly high, it is possible that jetting of ink might stop completely or that inkjet printer jetting performance would be otherwise severely compromised.

One method for solving this problem is to control jetted ink velocity by varying the voltage Vp (V) applied in order to produce the electric field at the piezoelectric member (the aforementioned partition 103) of the printhead in correspondence to changes in printhead temperature (° C.), i.e., ink temperature (° C.), so as to ensure satisfactory inkjet printer jetting performance. That is, as shown in FIG. 16, constant jetted velocity of ink droplets is maintained regardless of ink temperature (° C.), and deterioration of image quality is avoided, by causing the applied voltage Vp (V) to be set higher for lower ink temperatures (° C.).

However, with the aforementioned method in which applied voltage Vp is varied in correspondence to changes in ink temperature so as to achieve constant jetted velocity of ink droplets, the drive circuitry for jetting of ink droplets will require temperature sensors, variable voltage circuits, and so forth. This consequently creates a new problem in the form of the increased burden which is placed on the inkjet printer drive circuitry (first problem).

On the other hand, heat generated by a piezoelectric member contributes to increase in temperature of the piezoelectric member as well as surrounding circuitry, affecting the characteristics and longevity of the piezoelectric member itself as well as the surrounding circuitry. For this reason, stratagems such as those by which heat generated by piezoelectric members is dissipated through structural means have conventionally been devised. Disclosed at Japanese Patent Application Publication Kokai No. H9-48113 (1997) is a structure for preventing reduction in jetting performance due to changes in ink temperature, the structure being capable of preventing reduction in jetted ink velocity in low-temperature domains, despite the fact that the voltage which is supplied to the piezoelectric member is held constant, as a result of employment of a piezoelectric member having characteristics exhibiting a small rate of change of the electromechanical coupling coefficient with respect to temperature, the rate of change of the electromechanical coupling coefficient with respect to temperature being not more than 3,000 ppm/C.° at least in temperature domains of 20° C. or lower.

However, in conventional inkjet image forming apparatuses, suppression of the amount of heat generated by the piezoelectric member itself has not been carried out. That is, despite the fact that the amount of heat produced by the piezoelectric member itself when the temperature of the piezoelectric member rises may have been lowered as a consequence of the variation of applied voltage Vp in correspondence to change in ink temperature which has been carried out in conventional constitutions, such conventional constitutions have been devoid of any technology which would focus on reducing the amount of heat generated by this piezoelectric member and which would actively utilize same. Furthermore, due to the fact that it has only actually been possible to carry out control of applied voltage at intervals occurring at some fixed period and due to the fact that correction of jetted ink velocity has likewise only actually been achievable at some fixed period, further improvements in ink jetting performance have been difficult to accomplish. Indeed, at Japanese Patent Application Publication Kokai No. H9-48113 (1997), whereas attention is given to the rate of change of the electromechanical coupling coefficient with respect to temperature and there is improvement of ink jetting performance within low-temperature domains, suppression of the amount of heat generated by the piezoelectric member is not carried out and further improvement of ink jetting performance in domains other than the low-temperature domain would be difficult (second problem).

SUMMARY OF INVENTION

The present invention was conceived in light of the foregoing first problem and second problem, it being a first object thereof to provide an inkjet printhead and an inkjet image forming apparatus having high jetting performance and permitting improved stabilization of jetted ink droplet velocity without requiring that an increased burden be placed on the drive circuitry for jetting of ink droplets.

Furthermore, a second object of the present invention is to, in the context of an inkjet image forming apparatus equipped with an inkjet printhead, provide an inkjet image forming apparatus having high ink jetting performance and reliability wherein increase in the amount of heat generated by the piezoelectric member(s) itself or themselves, such piezoelectric member(s) making up at least wall(s) of inkjet printhead ink chamber(s), is suppressed; the range over which ink temperature fluctuates is reduced; and temperature compensation is carried out in more stable fashion.

In order to achieve the foregoing first object, an inkjet printhead in accordance with one or more embodiments of the present invention, in the context of an inkjet printhead wherein electrical energy is supplied to one or more piezoelectric members making up at least one wall of one or more ink chambers, causing deformation of at least one of the piezoelectric member or members, as a result of which at least a portion of the ink within at least one of the ink chamber or chambers is jetted toward one or more recording media, is characterized in that one or more rates of change with respect to temperature, of one or more electromechanical coupling coefficients of the piezoelectric member or members, exhibits negative characteristics.

What is here referred to as the electromechanical coupling coefficient is an indication of how much of the electrical energy which is supplied to a piezoelectric member is converted into mechanical energy. That is, when it is said that a "rate of change with respect to temperature, of an electromechanical coupling coefficient exhibits negative characteristics" what is meant is that the characteristics thereof are such that the efficiency with which electrical energy supplied to the piezoelectric member is converted into mechanical energy decreases as temperature increases. More specifically, such electromechanical coupling coefficient may be expressed as the square root of the value of the energy which is stored in mechanical form within the crystalline structure of the piezoelectric member divided by the aforementioned electrical energy.

The viscosity of ink jetted from the ink jet printhead decreases with increasing ink temperature. In other words, it exhibits negative temperature characteristics. In order to maintain constant jetted ink velocity, it will therefore be necessary, as ink temperature increases, to decrease the mechanical energy stored in the piezoelectric member responsible for jetting of ink. Stating this another way, in order to maintain constant jetted ink velocity, it will be necessary to decrease the aforementioned mechanical energy as the temperature of the piezoelectric member increases.

In accordance with the present solution means, which employs piezoelectric member(s) having electromechanical coupling coefficient(s) exhibiting negative temperature characteristics, the efficiency with which electrical energy supplied to piezoelectric member(s) is converted into mechanical energy decreases as the temperature of piezoelectric member(s) increases. This makes it possible for the piezoelectric member(s) to itself or themselves correct conversion efficiency or efficiencies (self-correction) so as to maintain constant jetted ink velocity, as a result of which the ink jetting performance of the inkjet printhead(s) is improved.

That is, when ink temperature is comparatively low, because this means that ink viscosity is high, ink viscosity characteristics would tend to cause decrease in jetted ink velocity. However, the characteristics of the electromechanical coupling coefficient(s) of the piezoelectric member(s) associated with the present solution means tend to cause increase in jetted ink velocity due to the improved efficiency with which electrical energy supplied to piezoelectric member(s) is converted into mechanical energy for jetting of ink.

Conversely, when ink temperature is comparatively high, because this means that ink viscosity is low, ink viscosity characteristics would tend to cause increase in jetted ink velocity. However, the characteristics of the electromechanical coupling coefficient(s) of the piezoelectric member(s) associated with the present solution means tend to cause decrease in jetted ink velocity due to the worsened efficiency with which electrical energy supplied to piezoelectric member(s) is converted into mechanical energy for jetting of ink.

As described above, the effect of ink viscosity characteristics on jetted ink velocity and the effect of piezoelectric member electromechanical coupling coefficient characteristics on jetted ink velocity are in directions which tend to cancel one another out. Even where the electrical energy supplied to piezoelectric member(s) is held constant, it is therefore possible to maintain constant jetted ink velocity through self-correction of conversion efficiency or efficiencies at the piezoelectric member(s) itself or themselves, permitting improvement in ink jetting performance of inkjet printhead(s).

Alternatively, in order to achieve the foregoing first object, an ink jet printhead in accordance with one or more embodiments of the present invention, in the context of a multidrop-type inkjet printhead wherein electrical energy is supplied to one or more piezoelectric members making up at least one wall of one or more ink chambers, causing deformation of at least one of the piezoelectric member or members and permitting a plurality of consecutively jetted ink droplets to be made to combine to form a single dot on recording medium or media, is characterized in that one or more rates of change with respect to temperature, of one or more electromechanical coupling coefficients of the piezoelectric member or members, exhibits negative characteristics.

The aforementioned multidrop-type inkjet printhead carries out n times as many ink jetting operations as an inkjet printhead that uses a single droplet of ink to form a single dot on the paper surface. The increase in temperature of the ink in a multidrop-type inkjet recording apparatus due to driving therefore being particularly severe, there will be greater need for temperature correction if ink jetting performance is to be maintained.

Moreover, because the plurality of ink droplets which combine to form a single dot are respectively jetted with different velocities, it is necessary that correction be carried out in correspondence to order of jetting. Furthermore, combined correction in correspondence to jetting order will result in further increase in the amount of correction which is required.

In accordance with the constitution of the present solution means, employment of piezoelectric member conversion efficiency self-correcting capability in such a multidrop-type inkjet printhead makes it possible to cause respective ink droplets to be jetted with proper velocities, making it possible to attain satisfactory image quality as formed by respective dots.

In addition to the foregoing respective solution means, a constitution permitting control of at least a portion of the electrical energy which is supplied to at least one of the piezoelectric member or members will, for example through combination with control of voltage(s) applied to piezoelectric member(s) or other such electrical correction, permit appropriate correction, making it possible for improved ink jetting performance to be achieved, even where it is not or would not have been possible to cause ink to be jetted at proper velocity or velocities as a result only of self-correction of conversion efficiency or efficiencies of the piezoelectric member(s) itself or themselves.

More specifically, when ink temperature is comparatively low, while the efficiency with which electrical energy supplied to piezoelectric member(s) is converted into mechanical energy for jetting of ink improves, tending to cause an increase in jetted ink velocity, in the event that circumstances are such that adequate ink jetting velocity has, despite this, not yet been attained, voltage(s) applied to piezoelectric member(s) might be controlled so as to cause such voltage(s) to be set to higher value(s). Conversely, when ink temperature is comparatively high, while the efficiency with which electrical energy supplied to piezoelectric member(s) is converted into mechanical energy for jetting of ink worsens, tending to cause a decrease in jetted ink velocity, in the event that circumstances are such that ink jetting velocity is, despite this, still too high, voltage(s) applied to piezoelectric member(s) might be controlled so as to cause such voltage(s) to be set to lower value(s).

Furthermore, such control of voltage(s) applied to piezoelectric member(s) is not limited to the foregoing. For example, voltage(s) applied to piezoelectric member(s) might be controlled so as to cause such voltage(s) to be set to lower value(s) when jetted ink velocity is too high despite the fact that ink temperature is comparatively low; and conversely, voltage(s) applied to piezoelectric member(s) might be controlled so as to cause such voltage(s) to be set to higher value(s) when jetted ink velocity is too low despite the fact that ink temperature is comparatively high. That is, in the event of overcorrection due to self-correction of conversion efficiency or efficiencies at piezoelectric member(s) itself or themselves, control of applied voltage(s) may be carried out in a direction such as will tend to cancel out same.

Furthermore, as compared with the situation where electrical correction is carried out alone, the present solution means makes it possible to reduce the amount of electrical correction as a result of combination with piezoelectric member self-correction. It is consequently possible to alleviate the burden which is placed on the drive circuitry, such as by permitting suppression of drive circuit power consumption, permitting reduction in power supply voltage, and so forth.

Alternatively, in order to achieve the foregoing first object, an inkjet printhead in accordance with one or more embodiments of the present invention, in the context of an inkjet printhead wherein electrical energy is supplied to one or more piezoelectric members making up at least one wall of one or more ink chambers, causing deformation of at least one of the piezoelectric member or members, as a result of which at least a portion of the ink within at least one of the ink chamber or chambers is jetted toward one or more recording media, is characterized in that it is constructed such that, taking ink viscosities at ink temperatures Ta (° C.) and Tb (° C.) to respectively be ηa and ηb, taking electrical capacitances of the piezoelectric member or members at those temperatures to respectively be Ca and Cb, taking electromechanical coupling coefficients of the piezoelectric member or members at those temperatures to respectively be Ka and Kb, and taking voltages supplied so as to cause deformation of at least one of the piezoelectric member or members at those temperatures to respectively be Va and Vb, the supplied voltages are set so as to satisfy $$(Va/Vb)^2=\alpha^2\times(Cb\times Kb^2\times\eta a)/(Ca\times Ka^2\times\eta b)$$

where $0.93\leqq\alpha\leqq1.14$.

Taking the case where jetted ink velocity is 8 m/sec, the foregoing constitution permits the tolerance for jetting velocity deviation to be held within the range from −2 m/sec to +4 m/sec. That is, at 600 dpi (42μ), error in the location at which ink droplets land can be held to ± half the dot pitch (21μ) or lower.

Furthermore, also within the purview of the technical idea of the present invention are inkjet image forming apparatuses employing one or more inkjet printheads according to any one of the foregoing respective solution means and constituted so as to permit ink droplets to be jetted toward one or more recording media from at least one ink chamber of at least one of the inkjet printhead or printheads so as to form one or more images on at least one surface of at least one of the recording medium or media.

Alternatively, in order to achieve the foregoing second object, an ink jet image forming apparatus in accordance with one or more embodiments of the present invention, in the context of an inkjet image forming apparatus equipped with one or more inkjet printheads wherein electrical energy is supplied to one or more piezoelectric members making up at least one wall of one or more ink chambers, causing deformation of at least one of the piezoelectric member or members, as a result of which at least a portion of the ink within at least one of the ink chamber or chambers is jetted toward one or more recording media, is characterized in that it is provided with one or more means for controlling at least a portion of the electrical energy supplied to at least one of the piezoelectric member or members based on image data and ink temperature; and one or more rates of change with respect to temperature, of one or more electromechanical coupling coefficients of the piezoelectric member or members, exhibits positive characteristics.

In such constitution, at least portion(s) of ink chamber(s) from which ink is jetted is or are constructed from piezoelectric member(s) for which rate(s) of change of electromechanical coupling coefficient(s) with respect to temperature exhibit positive characteristics, and control of electrical energy to be supplied to piezoelectric member(s) during jetting of ink is carried out by control means based on image data and ink temperature. Accordingly, as temperature rises, electromechanical coupling coefficient(s) of piezoelectric member(s) increase and the efficiency with which electrical energy supplied to piezoelectric member(s) is converted into mechanical energy improves, reducing the amount of electrical energy required for jetting of ink as a result of mechanical deformation of piezoelectric member(s) and permitting reduction in voltage(s) applied to piezoelectric member(s). Furthermore, as temperature increases, decrease in ink viscosity makes it easier to jet ink, reducing the amount of electrical energy required for jetting of ink and permitting further reduction in voltage(s) applied to piezoelectric member(s). The amount of heat generated by a piezoelectric member being proportional to the product of the electrical capacitance of the piezoelectric member and the square of the voltage applied thereto, the fact that applied voltage can be reduced as the temperature of the ink and the piezoelectric member increases makes it possible for there to be no marked increase in the amount of heat generated by the piezoelectric member itself as temperature increases and makes it possible to minimize the range over which the temperature of the ink, the piezoelectric member, and surrounding circuitry fluctuates. This makes it possible to reduce the range over which ink viscosity varies. Furthermore, the effect on characteristics and longevity of piezoelectric member(s) and surrounding circuitry caused by variation in temperature can be reduced.

Furthermore, in an inkjet image forming apparatus in accordance with one or more embodiments of the present invention, at least one of the control means may be characterized in that it permits the number of times electrical energy is supplied per dot to be varied in correspondence to image density.

In such constitution, at least portion(s) of ink chamber(s) to which electrical energy is supplied a plurality of times per dot in correspondence to image density is or are constructed from piezoelectric member(s) for which rate(s) of change of electromechanical coupling coefficient(s) with respect to temperature exhibit positive characteristics, and control of electrical energy to be supplied to piezoelectric member(s) during jetting of ink is carried out by control means based on image data and ink temperature. Accordingly, while a multidrop-type inkjet image forming apparatus which consecutively jets a plurality of ink droplets per dot in correspondence to image density might supply electrical energy to piezoelectric member(s) more times than a single-drop-type inkjet image forming apparatus which carries out image formation using a single droplet of ink per dot, might—due to the different respective velocities with which the plurality of ink droplets are jetted—carry out correction of applied voltage with respect to temperature more times than such a single-drop-type inkjet image forming apparatus, and might experience more severe temperature fluctuations than such a single-drop-type ink jet image forming apparatus, provision of piezoelectric member(s) exhibiting positive characteristics in rate(s) of change of electromechanical coupling coefficient(s) with respect to temperature will make it possible to prevent marked increase in temperature of ink, piezoelectric member(s), and surrounding circuitry and will make it possible to minimize the range over which ink viscosity varies.

BRIEF DESCRIPTION OF DRAWINGS

FIG. 7(*b*) is a drawing to assist in description of deformation action at partitions making up ink chambers, suction of ink being shown.

FIG. 7(*c*) is a drawing to assist in description of deformation action at partitions making up ink chambers, jetting of ink being shown.

FIG. 8(*b*) shows the drive pulse at a jetting B channel.

FIG. 8(*c*) shows the drive pulse at a non-jetting C channel.

FIG. 8(*d*) shows the situation at an ink chamber associated with a jetting channel.

FIG. 9(*b*) is a drawing to assist in description of control operations for jetting of ink droplets from respective ink chambers, the situation that exists when the interiors of a second and a third ink chamber are enlarged being shown.

FIG. 9(*c*) is a drawing to assist in description of control operations for jetting of ink droplets from respective ink chambers, the situation that exists when the interiors of a second and a third ink chamber are made to shrink being shown.

FIG. 10(*b*) is a drawing showing the timing with which a common voltage pulse is applied.

DESCRIPTION OF PREFERRED EMBODIMENTS

Below, embodiments of the present invention are described with reference to the drawings, the present invention being here applied to a color inkjet printer. Note that the first embodiment corresponds to the foregoing first object, and the second embodiment corresponds to the second object.

First Embodiment

Figure 1:
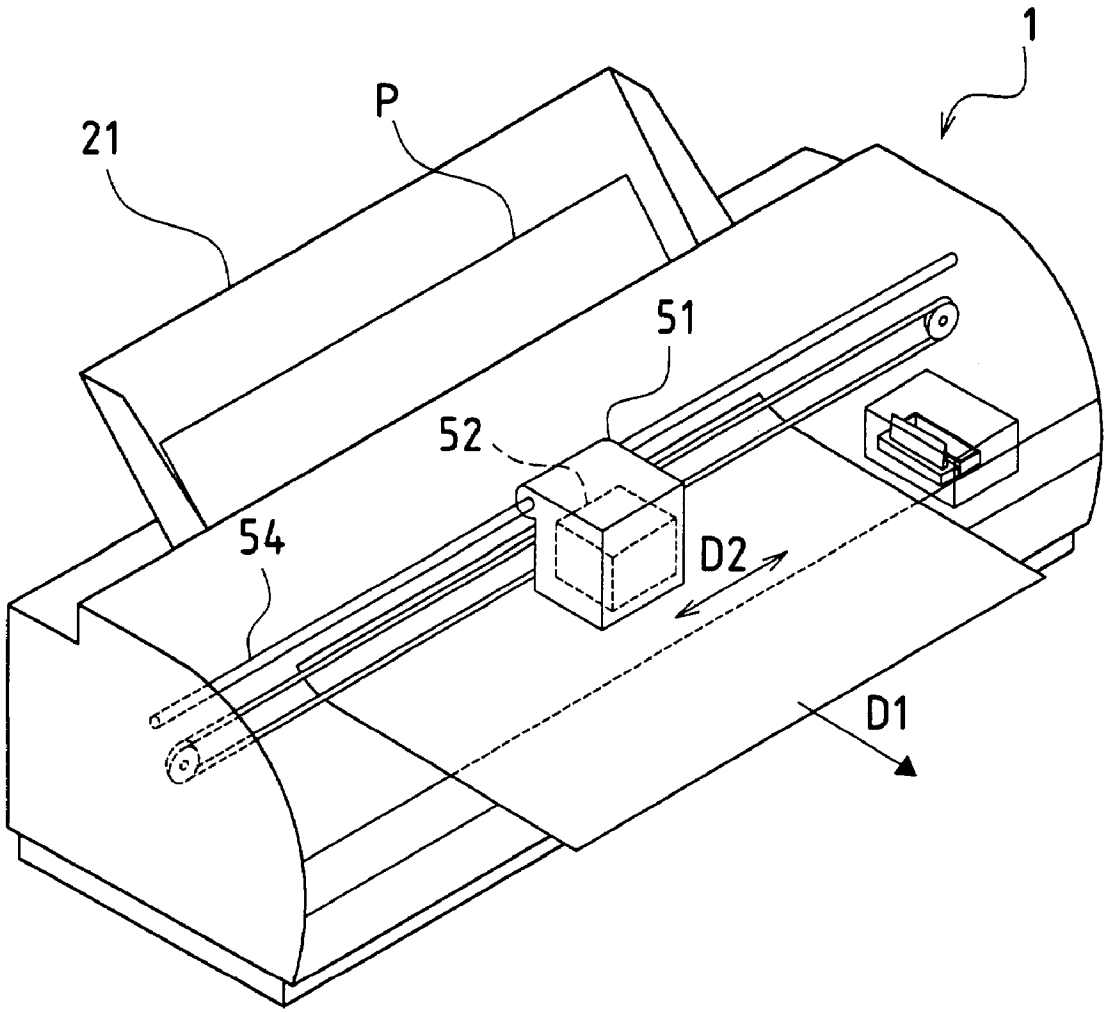
FIG. 1 is an oblique view showing the external appearance and a portion of the internal constitution at the interior of a color inkjet printer associated with a first embodiment of the present invention.
Figure 2:
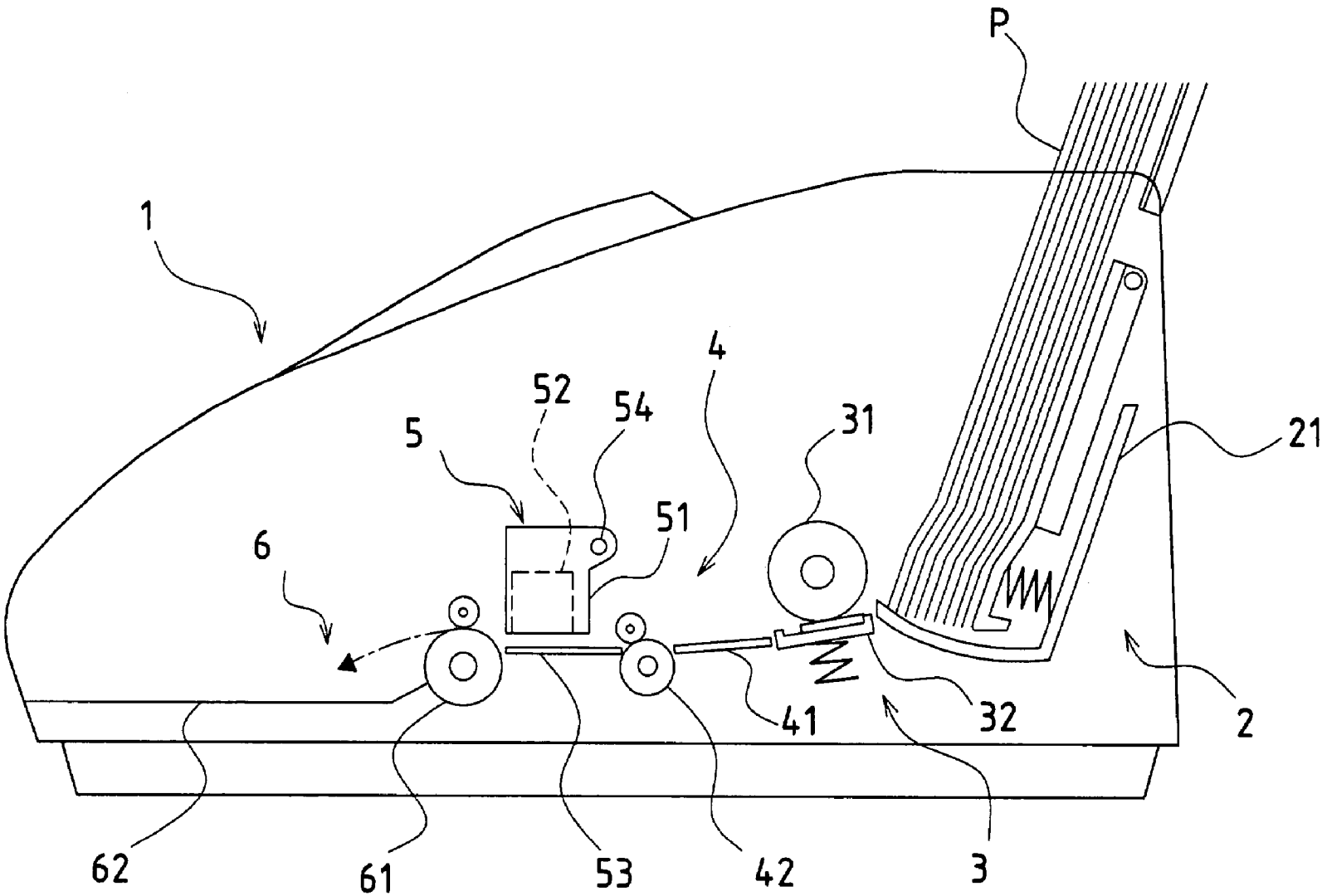
FIG. 2 is a side view showing the internal constitution of a color inkjet printer associated with a first embodiment of the present invention.

FIG. 1 is an oblique view showing the external appearance (the top of the housing being omitted) and a portion of the internal constitution at the interior of a color inkjet printer 1 associated with a first embodiment of the present invention. Furthermore, FIG. 2 is a side view showing the internal constitution of color inkjet printer 1.

As shown in these drawings, color inkjet printer 1 associated with the first embodiment is provided with media supply unit 2, separating unit 3, transport unit 4, printing unit 5, and discharge unit 6.

Media supply unit 2 is provided with media supply tray 21 extending in a more or less vertical direction and a pickup roller, not shown, and at a time when printing is initiated, recording paper P serving as recording media within media supply tray 21 is removed therefrom by the pickup roller so as to be transported toward separating unit 3. Furthermore, at times when printing is not being carried out, the aforementioned media supply tray 21 functions as storage unit for recording paper P.

Separating unit 3, for supplying recording paper P supplied thereto from media supply unit 2 to printing unit 5 one sheet at a time, is provided with supply roller 31 and separator 32. At separator 32, the force of friction between a pad region (region of contact with recording paper P) and recording paper P is set so as to be greater than the force of friction between respective sheets of recording paper P, P. Furthermore, at supply roller 31, the force of friction between this supply roller 31 and recording paper P is set so as to be greater than the force of friction between the pad region of separator 32 and recording paper P and greater than the force of friction between respective sheets of recording paper P. P. For this reason, even if multiple sheets of recording paper P, P, . . . are picked up by the pickup roller and are fed to separating unit 3, supply roller 31 will be able to separate these multiple sheets of recording paper P, P, . . . and feed only the topmost sheet of recording paper P to transport unit 4.

Transport unit 4, for transporting to printing unit 5 recording paper P supplied thereto one sheet at a time from separating unit 3, is provided with guide plate 41 and pair of transport rollers 42. Transport roller pair 42 adjusts transport of recording paper P so as to cause ink droplets from inkjet printhead 52 to be jetted onto recording paper P at an appropriate location thereof when recording paper P is fed between inkjet printhead 52 and platen 53.

Printing unit 5, for carrying out printing of images on recording paper P supplied thereto from transport roller pair 42 of transport unit 4, is provided with a plurality of ink reservoirs (not shown), inkjet printhead 52, carriage 51 carrying these ink reservoirs and this inkjet printhead 52, guide shaft 54 for guiding this carriage 51 in a scan direction, and the aforementioned platen 53 serving as support stage for recording paper P during printing. Furthermore, the aforementioned ink reservoirs are such that separate cartridges for each of Bk (black), C (cyan), M (magenta), and Y (yellow) inks are respectively installed at carriage 51, permitting each to be replaced independent of the others.

Discharge unit 6, being a component for retrieval of recording paper P on which printing has been carried out, is provided with an ink drying unit (not shown) for drying ink present on recording paper P, discharge roller pair 61, and discharge tray 62.

In the context of the foregoing constitution, color inkjet printer 1 carries out printing by means of operations such as the following. First, a request for color inkjet printer 1 to use image information to carry out printing is made from a computer or other such external terminal, not shown. Color inkjet printer 1, having received the printing request, uses the pickup roller to cause recording paper P in media supply tray 21 to exit media supply unit 2. Next, recording paper P, having exited therefrom, is by means of supply roller 31 made to pass through separating unit 3 and to be delivered to transport unit 4. At transport unit 4, transport roller pair 42 causes recording paper P to be fed between inkjet printhead 52 and platen 53. In addition, at printing unit 5, ink droplets are jetted from ink jets present on inkjet printhead 52 onto recording paper P lying on platen 53 in correspondence to image information (ink droplet jetting operations occurring at this time will be described below). At this time, movement of recording paper P is paused as it is held stationary over platen 53. Carriage 51, guided by guide shaft 54, is made to scan in a motion corresponding to one line in the scan direction (the D2 direction at FIG. 1) while ink droplets are jetted therefrom. Upon completion thereof, recording paper P is made to move over platen 53 by a fixed distance in the cross-scan direction (the D1 direction at FIG. 1). At printing unit 5, by continuing to perform the foregoing processing in correspondence to image information, printing is carried out over the entire expanse of recording paper P. Recording paper P, printing having thus been carried out thereon, passes through the ink drying unit and is discharged by discharge roller pair 61 into discharge tray 62. As a result hereof, recording paper P is provided to the user as printed output.

The foregoing operations of the various components may be controlled by a controller. Such a controller is described below.

Figure 3:
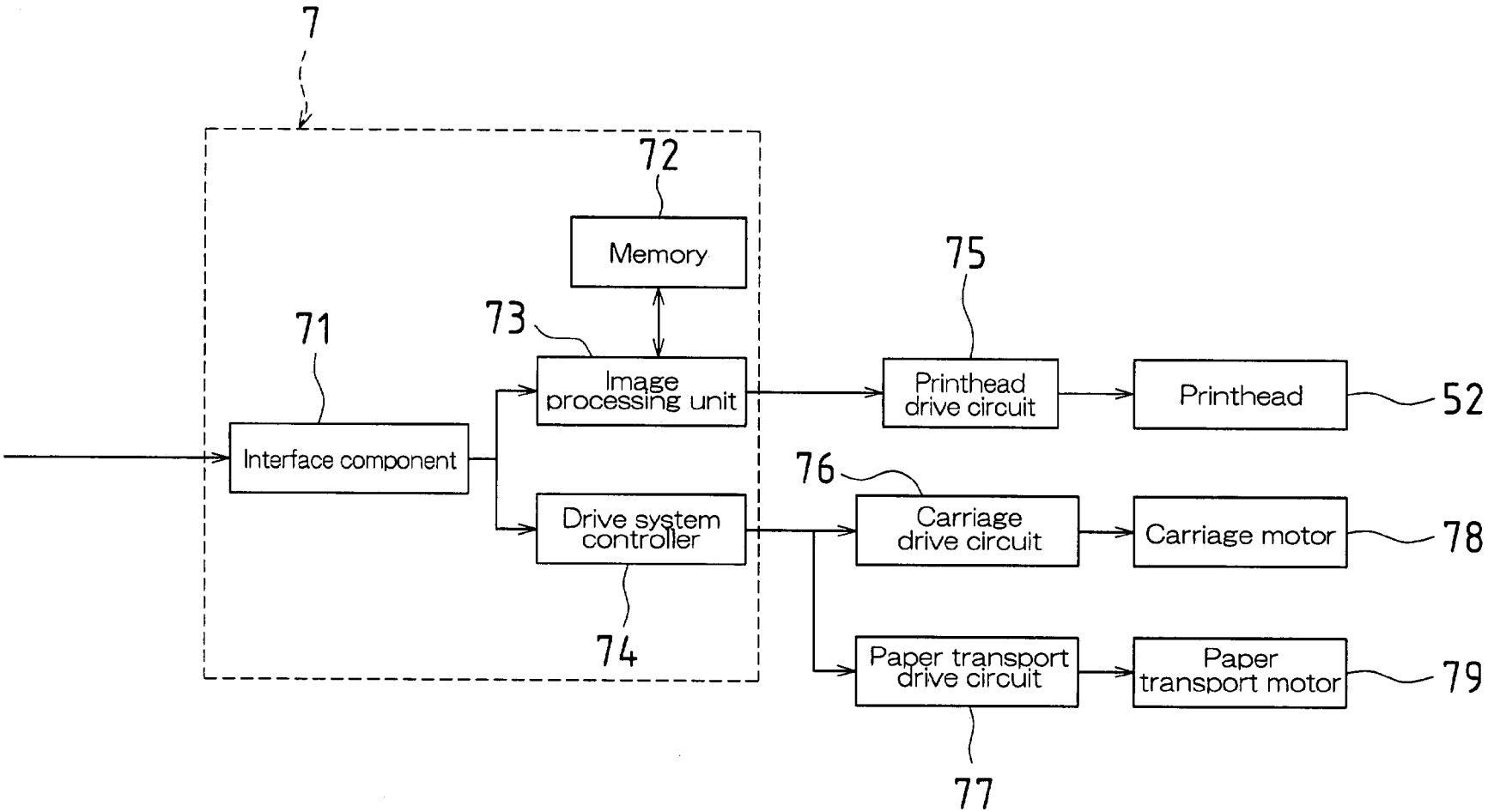
FIG. 3 is a block diagram showing the constitution of a controller for a color inkjet printer associated with a first embodiment of the present invention.

FIG. 3 is a block diagram showing the constitution of a controller 7 for a color inkjet printer 1 associated with a first embodiment of the present invention. This controller 7 is provided with interface component 71, memory 72, image processing unit 73, and drive system controller 74.

Interface component 71 is a circuit for transmitting and receiving signals sent between external equipment and image processing unit 73 and/or drive system controller 74.

Memory 72 is a storage component for temporarily storing image information received from interface component 71.

Image processing unit 73 carries out image processing based on image information received from interface component 71. Furthermore, image processing unit 73 is connected to printhead drive circuit 75, which controls driving of inkjet printhead 52.

Drive system controller 74 controls driving of carriage 51 and transport of recording paper P. Drive system controller 74 is connected to carriage drive circuit 76, which controls driving of carriage motor 78, and paper transport drive circuit 77, which controls driving of paper transport motor 79.

By virtue of the foregoing circuit structure, the present color inkjet printer 1 is constituted so as to be able to carry out driving of inkjet printhead 52, carriage 51, paper transport motor 79, and so forth, as a result of which printing operations can be carried out on the aforementioned recording paper P.

Figure 4:
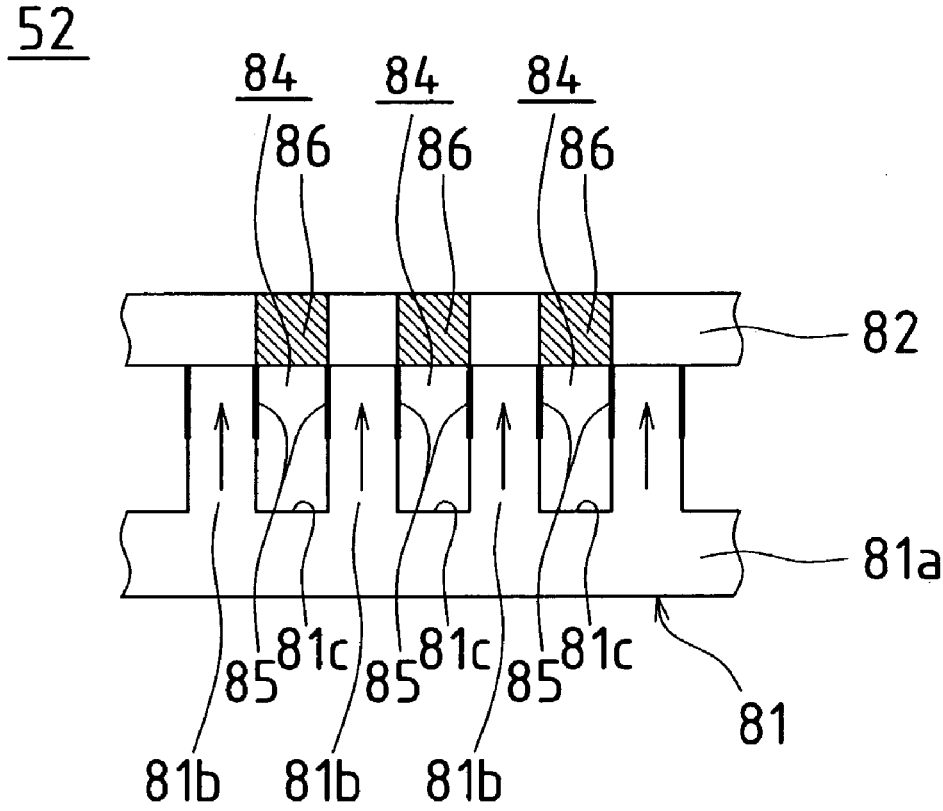
FIG. 4 is a bottom view of an inkjet printhead.
Figure 5:
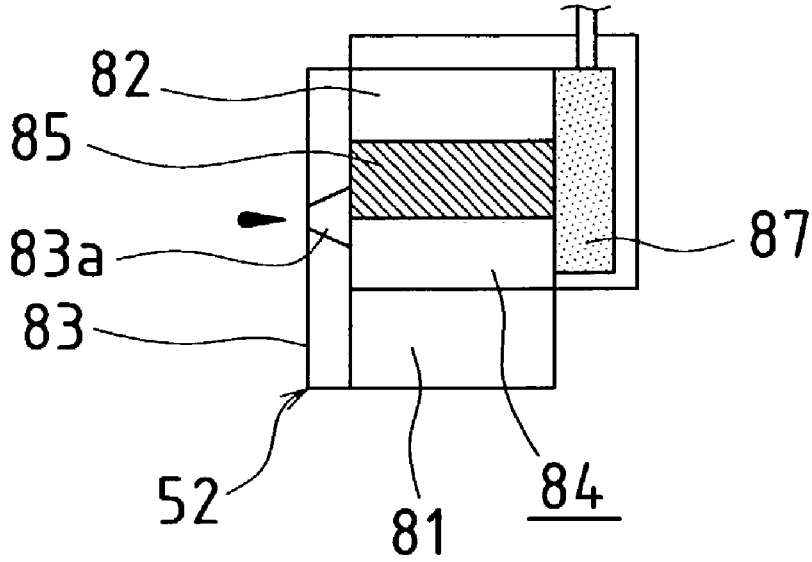
FIG. 5 is a sectional view of an inkjet printhead.

The constitution of an inkjet printhead 52 associated with the first embodiment, as well as ink jetting operations therein, are next described. FIG. 4 is a bottom view of inkjet printhead 52, shown with nozzle plate 83, described below, omitted. FIG. 5 is a sectional view of inkjet printhead 52 (the left side in the drawing corresponding to the bottom when actually installed). As shown in these drawings, inkjet printhead 52 is equipped with base plate 81, cover plate 82, and nozzle plate 83.

Base plate 81, formed from piezoelectric material such that the cross-section thereof resembles the teeth of a comb, is equipped with floorwall 81*a* and a plurality of partitions 81*b*, 81*b*, . . . arranged above this floorwall 81*a*. These partitions 81*b*, 81*b*, . . . are arranged so as to be mutually parallel with a prescribed pitch therebetween. As a result, a plurality of cavities 81*c*, 81*c*, . . . for formation of ink chamber(s) 84, described below, are formed in the spaces between respective partitions 81*b*, 81*b*. Furthermore, partitions 81*b* of the aforementioned base plate 81 are polarized in the direction of the height thereof (the direction indicated by the arrow at FIG. 4).

Figure 6:
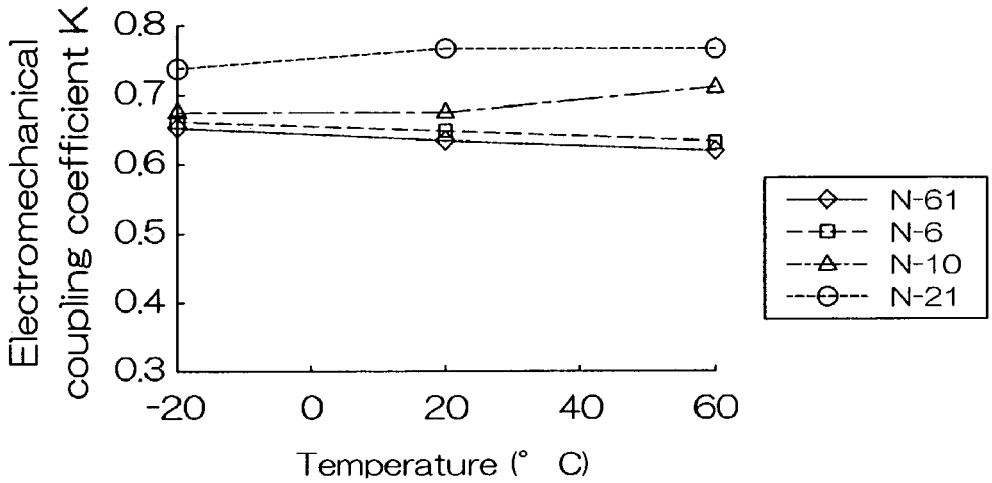
FIG. 6 is a drawing showing the relationship between temperature and electromechanical coupling coefficient for piezoelectric members for which rates of change of electromechanical coupling coefficients with respect to temperature exhibit positive characteristics and piezoelectric members for which rates of change of electromechanical coupling coefficients with respect to temperature exhibit negative characteristics.

Furthermore, while the piezoelectric member(s) (piezoelectric material) making up this base plate 81 may, as shown in FIG. 6, be such that rate(s) of change (K) of electromechanical coupling coefficient(s) thereof with respect to temperature exhibit positive characteristics (N-21 and N-10 in the drawing) or negative characteristics (N-6 or N-61 in the drawing), in color inkjet printer 1 associated with the first embodiment piezoelectric member(s) having negative characteristics are used. Operation and effects made possible as a result of employment of such piezoelectric member(s) for which rate(s) of change of electromechanical coupling coefficient(s) exhibit negative characteristics will be described below.

Cover plate 82 is attached in integral fashion over the aforementioned base plate 81, closing off the tops of respective cavities 81*c*, 81*c*, . . . As result, the spaces enclosed by floorwall 81*a* and partitions 81*b* of base plate 81 and by cover plate 82 are made to constitute ink chambers 84, a plurality of such ink chambers 84 being arranged in a horizontal direction so as to straddle partitions 81*b*. Furthermore, the respective ink chambers 84 are connected to ink reservoirs by way of common ink passages 87. That is, ink within ink reservoirs is supplied to respective ink chambers 84 by way of common ink passages 87, there being a separate common ink passage 87 for each ink color.

Drive electrodes 85 are formed on the aforementioned base plate 81. As shown in FIG. 4, these drive electrodes 85 are formed on the sides of respective partitions 81*b* of base plate 81, at regions located more or less in the upper halves thereof (see cross-hatched locations in FIG. 5). Moreover, these drive electrodes 85 are such that those provided within the same ink chamber 84 are mutually connected by means of connecting electrode 86 comprising electrically conductive resin (see cross-hatched locations in FIG. 4). Furthermore, connected to connecting electrodes 86 are electrode(s), not shown, for external connection. The constitution here is such that application of pulsed voltage(s) from printhead drive circuit 75 to such electrode(s) for external connection permits same pulsed voltage(s) to be applied to the two drive electrodes 85, 85 which face one another within ink chamber 84.

Nozzle plate 83, being attached to the front side (the left side in FIG. 5) of base plate 81 and cover plate 82, closes off ink chambers 84, and nozzles 83*a*, 83*a* . . . are moreover formed therein in correspondence to respective ink chambers 84, 84, . . . . That is, the constitution here is such that when pressure for jetting of ink is produced within ink chamber 84, ink droplet(s) of prescribed size is or are jetted from nozzle 83*a* which abuts this ink chamber 84.

More specifically, in the inkjet printhead 52 associated with the first embodiment, the aforementioned respective ink chambers 84 are 1.1 mm in length (active length), 300 μ in height, and 84 μ in width; partitions 81*b* are 85 μin width; and the pitch between ink chambers 84 is equivalent to 150 dpi, i.e., 1/150 inch. Furthermore, drive electrodes 85 are made from A1 film formed by oblique vacuum deposition to a location 150 μ from the top end of partitions 81*b*. Operations for formation of these drive electrodes 85 are such that after using the aforementioned oblique vacuum deposition to apply A1 film over a region including the sides of partitions 81*b* in a zone corresponding to roughly the upper halves thereof and extending to the tops thereof, the portion of the film at the tops thereof is removed by grinding so as to separate the A1 films on the respective sides of partitions 81*b*, following which the A1 films which face one another within each ink chamber 84 are electrically connected to each other by means of connecting electrode 86. Furthermore, cover plate 82 is made to adhere to the tops of partitions 81*b* by means of adhesive, plate that the thickness of this adhesive layer (not shown in the drawings) being set so as to be 1 μ or less. Moreover, the diameter of nozzles 83*a* formed in nozzle plate 83 is 17 μ on the side at which the jetted ink is ejected. This nozzle plate 83 may be obtained by coating polyimide film with water-repellent film and thereafter using an excimer laser to form plurality of nozzles 83*a*, 83*a*, . . . comprising through-holes. The pitch between these nozzles 83*a*, 83*a*, . . . is the same as the pitch between the aforementioned ink chambers 84, 84, . . . ; i.e., 150 dpi. Note that the foregoing respective dimensions and manufacturing methods are not limited to those presented herein.

Furthermore, inkjet printhead 52 is not limited to the aforementioned shear strain type, it being possible to employee printhead(s) of the unimorph type, thickness-direction strain type, axial-direction strain type, laminated piezoelectric member type, and so forth. In particular, it is preferred that electromechanical coupling coefficient be large and that temperature dependence be small.

Figure 9A:
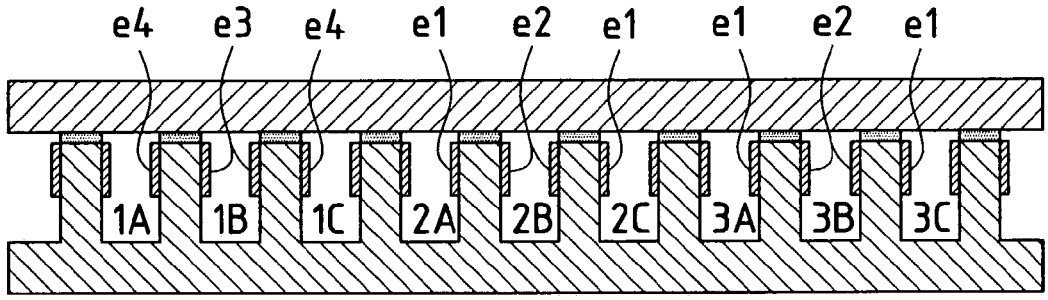
FIG. 9(*a*) is a drawing to assist in description of control operations for jetting of ink droplets from respective ink chambers, the ordinary situation being shown.
Figure 9B:
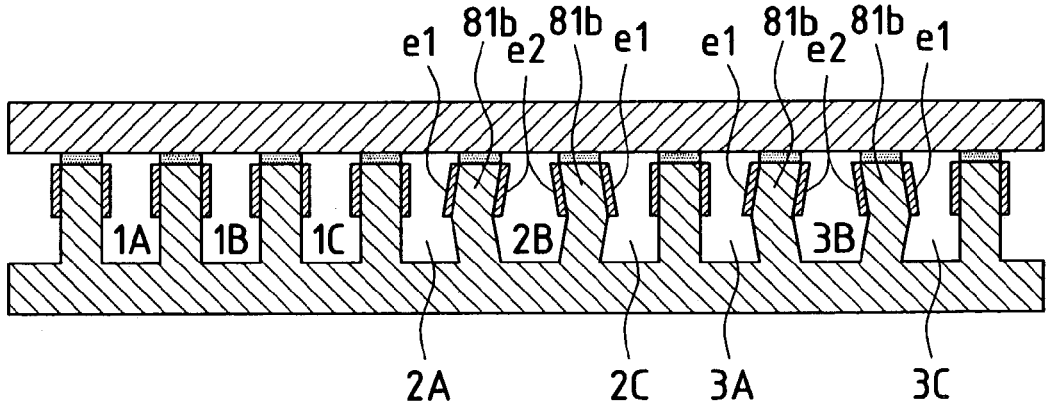
Figure 9C:
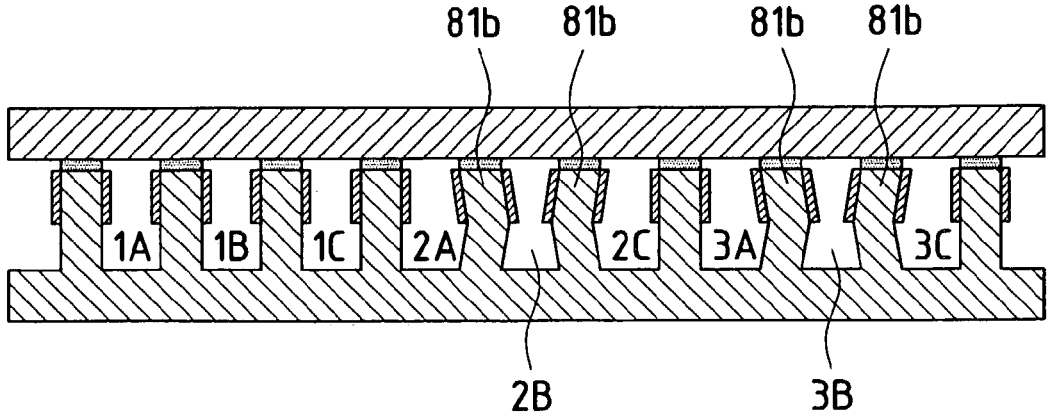

Below, ink droplet jetting operations are described. Ink droplet jetting operations in the present inkjet printer 1 are basically such that a plurality of ink chambers 84, 84, . . . disposed at a prescribed interval (e.g., every third thereof) mutually form a single ink chamber channel so as to constitute a plurality of channels, control of jetting of ink droplets being carried out sequentially for respective channels. More specifically, as shown in FIGS. 9(*a*) through (*c*), the plurality represented by every third ink chamber 84, 84, . . . mutually constitute a single channel, control of jetting of ink droplets being carried out with respect to the three channels A, B, and C. Before describing control operations for these respective channels, deformation action taking place at partitions 81*b* for jetting of ink droplets will be described.

Figure 7A:
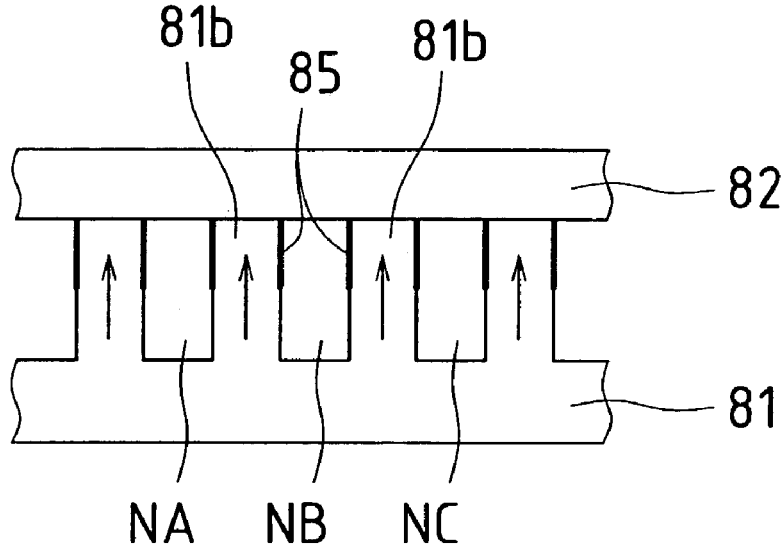
FIG. 7(*a*) is a drawing to assist in description of deformation action at partitions making up ink chambers, a rest interval being shown.
Figure 7B:
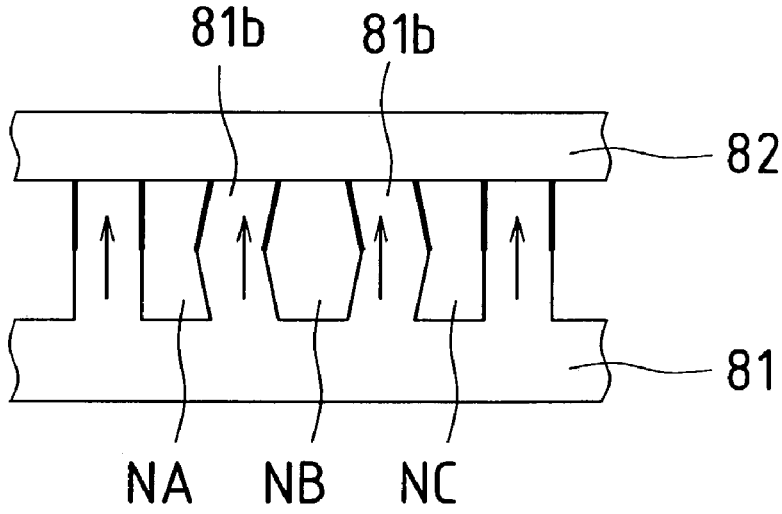
Figure 7C:
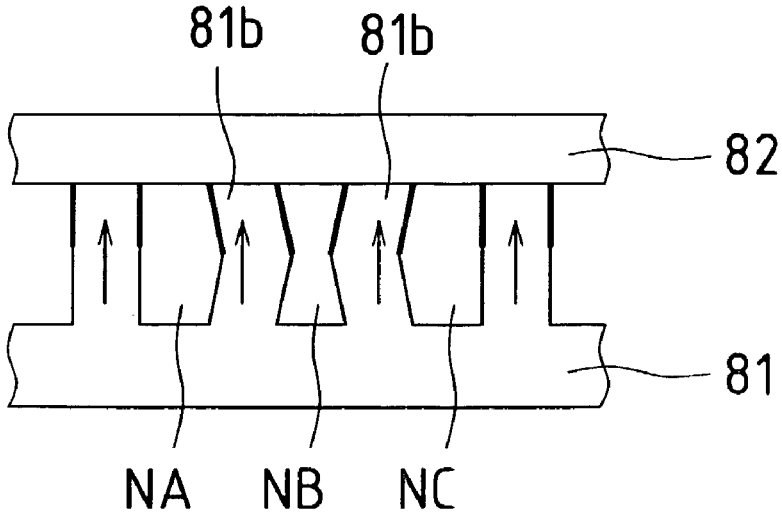

FIGS. 7(*a*) through (*c*) are drawings to assist in description of deformation action at partitions 81*b*, 81*b* making up ink chambers NA, NB, NC, jetting of ink from ink chamber NB being shown. FIG. 7(*a*) shows a situation where no jetting voltage pulse is applied at any of the channels. The state is referred to as a rest interval. FIG. 7(*b*) shows a situation where expansion of channel NB causes ink to be sucked into this channel NB. FIG. 7(*c*) shows a situation where contraction of channel NB causes ink to be jetted from the nozzle(s) of this channel NB.

Figures 8A, 8B, 8C, 8D:
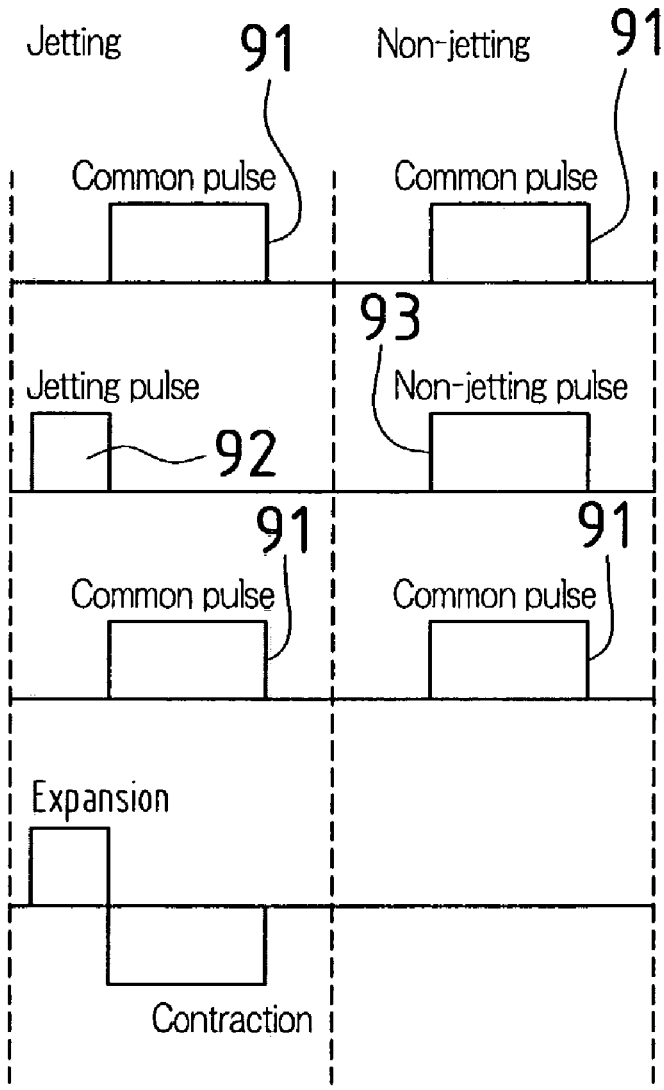
FIG. 8(*a*) shows the drive pulse at a non-jetting A channel.

Furthermore, FIGS. 8(*a*) through (*d*) are drawings to assist in description of the change in the pulsed drive voltage and in electric potential difference between electrodes at the respective channels. FIG. 8(*a*) shows the drive pulse at non-jetting A channel, this taking the form of common pulse 91 during both jetting and non-jetting. FIG. 8(*b*) shows the drive pulse at jetting B channel, this taking the form of jetting pulse 92 during jetting and non-jetting pulse 93 during non-jetting. FIG. 8(*c*) shows the drive pulse at non-jetting C channel, this taking the form of common pulse 91 during both jetting and non-jetting, just as was the case with the drive pulse at the non-jetting A channel. FIG. 8(*d*) shows the situation at the ink chamber of a jetting channel, showing how during jetting the ink chamber first expands (the interval corresponding to jetting pulse 92 at FIG. 8(*b*)) and then contracts (the interval corresponding to common pulse 91 of FIGS. 8(*a*) and (*c*)). Here, the pulse waveforms during expansion of channel NB shown in FIG. 7(*b*) and during contraction of channel NB shown in FIG. 7(*c*) are employed during jetting shown in FIGS. 8(*a*) through (c).

Below, control operations carried out with respect to respective channels are described. At FIGS. 9(*a*) through (*c*), the several channels each comprise three—first, second, and third—ink chambers, these being collectively labeled 1A through 3C. In these drawings, the first ink chamber of the A channel is assigned reference numeral 1A, the second ink chamber thereof is assigned reference numeral 2A, and the third ink chamber thereof is assigned reference numeral 3A. Furthermore, the first ink chamber of the B channel is assigned reference numeral 1B, the second ink chamber thereof is assigned reference numeral 2B, and the third ink chamber thereof is assigned reference numeral 3B. Reference numerals are likewise assigned to the C channel in similar fashion.

Consider now a situation in which the B channel is the channel that is the target of control of jetting of ink droplets, and in which ink droplets are to be jetted from second ink chamber 2B and third ink chamber 3B of this B channel. At such a time, voltage(s) are applied such that drive electrodes e1, e1, . . . at ink chambers 2A, 2C, 3A, 3C adjacent and to either side of these respective ink chambers 2B, 3B are at a low level, and drive electrodes e2, e2, . . . at second ink chamber 2B and third ink chamber 3B are at a high level (jetting pulse 92 at FIG. 8(*b*)). This causes production of an electric potential difference between drive electrodes e2, e2, . . . at this second ink chamber 2B and this third ink chamber 3B on the one hand and the drive electrodes e1, e1, . . . which are respectively adjacent thereto on the other, action of the electric field produced at such time causing shear deformation of respective partitions 81*b*, 81*b*, . . . making up second ink chamber 2B and third ink chamber 3B and causing enlargement of the interiors of these second and third ink chambers 2B, 3B (see FIG. 9(*b*)). Thereafter, the high level voltage(s) which were applied at drive electrodes e2, e2, . . . of B channel second ink chamber 2B and third ink chamber 3B are removed therefrom, and high level voltage(s) are applied at drive electrodes e1, e1, . . . of ink chambers 2A, 2C, 3A, 3C located to either side of these ink chambers 2B, 3B (common pulse 91 at FIGS. 8(*a*) and (*c*)). This causes an electric field opposite in direction to that which was described above to act between drive electrodes e2, e2, . . . of ink chambers 2B and 3B on the one hand and drive electrodes e1, e1, . . . respectively adjacent thereto on the other, causing shear deformation of partitions 81*b*, 81*b*, . . . making up second ink chamber 2B and third ink chamber 3B and causing shrinkage of the interiors of these ink chambers 2B and 3B (see FIG. 9(*c*)). As a result, prescribed jetting pressure (wave motion) is produced within ink chambers 2B and 3B, and ink droplet(s) is or are jetted from nozzle(s). By thus applying common pulse voltage(s) simultaneous with removal of previously applied jetting pulse voltage(s), enlargement and shrinkage of ink chambers 2B and 3B can be made to occur in consecutive fashion, permitting ink droplet jetting operations to occur.

On the other hand, in the case of the foregoing ink droplet jetting operations, in order that B channel first ink chamber 1B does not jet ink droplets, the same voltage(s) (non-jetting pulse 93 at FIG. 8(*b*)) as at drive electrodes e4, e4, . . . of ink chambers 1A and 1C located to either side of this first ink chamber 1B are applied with the same timing to drive electrodes e3, e3 of this first ink chamber 1B, the aforementioned shear deformation being made not to occur due to the fact that no electric potential difference is produced between electrodes.

After such ink droplet jetting control operations have been carried out with respect to the B channel, ink droplet jetting control operations are next carried out with respect to respective ink chambers 1C, 2C, 3C of the C channel. By sequentially transferring control of drive pulse voltage(s) among respective channels A, B, and C in this fashion, efficient use is made of all ink chambers 1A through 3C as ink jetting operations are continuously carried out.

Figures 10A, 10B:
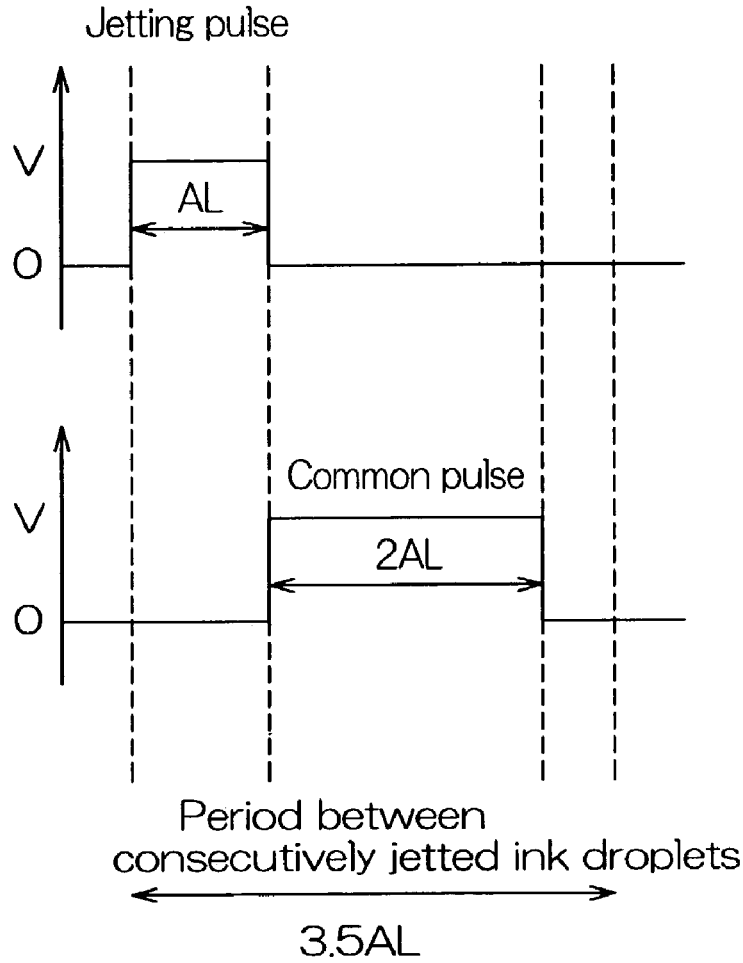
FIG. 10(*a*) is a drawing showing the timing with which a jetting voltage pulse is applied.

Moreover, when applying jetting pulse voltage(s) to drive electrodes 85 and causing partitions 81*b* to actuate in direction(s) resulting in expansion of ink chamber(s) 84, if the time during which application of such jetting pulse voltage(s) is or are maintained (the jetting pulse pulsewidth) is made equal to the time L/a it takes for the pressure wave within ink chamber(s) 84 to propagate once along the long direction of ink chamber(s) 84 (L being the length of ink chamber(s) 84, and a being the speed of sound in ink), this will make it possible for pressure fluctuations to increase in size with greatest efficiency, permitting improvement in jetting efficiency to be achieved and permitting high ink droplet jetting velocity to be attained. As shown in FIG. 10(*a*) and FIG. 10(*b*), in the first embodiment, taking the time it takes for the pressure wave responsible for jetting of ink droplets to propagate from the back end region of an ink chamber to the ink jetting region at the front end thereof to be AL, the times of application of the respective drive pulse voltages are respectively set such that jetting pulse voltage application time is AL, common pulse voltage application time is 2 AL, and the period between consecutively jetted ink droplets is 3.5 AL. Here, AL is ordinarily on the order of several μs. Furthermore, the respective drive pulse voltages are set such that the voltage values thereof are mutually identical, permitting employment of a shared power supply.

In a color inkjet printer 1 carrying out the foregoing jetting operations, piezoelectric material(s) employed as material(s) from which base plate 81 of inkjet printhead 52 is composed is or are such that rate(s) of change with respect to temperature of electromechanical coupling coefficient(s) thereof exhibit negative characteristics. What is here referred to as the electromechanical coupling coefficient, being an indication of how much of the electrical energy which is supplied to a piezoelectric member is converted into mechanical energy, may be expressed as the square root of the value of the energy which is stored in mechanical form within the crystalline structure of the piezoelectric member divided by the aforementioned electrical energy.

Figure 16:
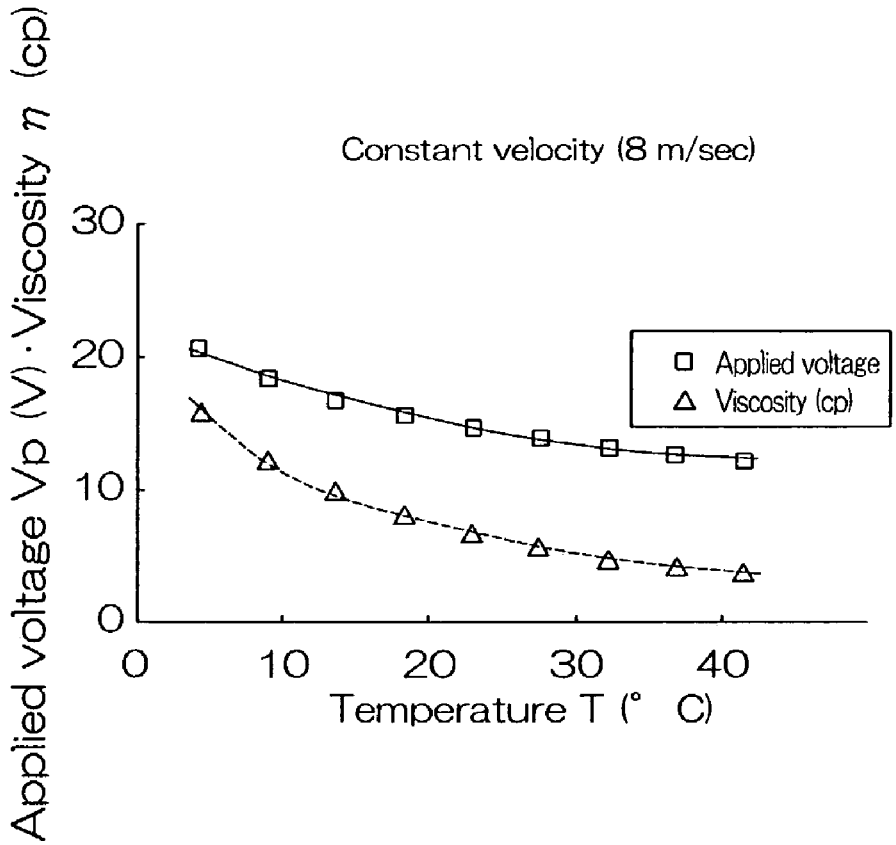
FIG. 16 shows the relationship between ink viscosity and the voltage which must be applied as a function of ink temperature in a conventional example.

As shown in FIG. 16, the viscosity η of the ink jetted from inkjet printhead 52 exhibits negative temperature characteristics, meaning that the value thereof decreases with increasing ink temperature. In order to maintain constant jetted ink velocity, it will therefore be necessary, as ink temperature increases, to decrease the mechanical energy stored in the piezoelectric member (hereinafter referred to as "partition 81*b*") responsible for jetting of ink. Stating this another way, in order to maintain constant jetted ink velocity, it will be necessary to decrease the aforementioned mechanical energy as the temperature of partitions 81*b* increases.

Where a base plate 81 comprising piezoelectric material(s) having electromechanical coupling coefficient(s) exhibiting negative temperature characteristics is employed, as in the first embodiment, the efficiency with which electrical energy supplied to partitions 81*b* is converted into mechanical energy decreases as the temperature of partitions 81*b* increases. This makes it possible for the partitions 81*b* to themselves correct conversion efficiency or efficiencies (self-correction) so as to maintain constant jetted ink velocity, as a result of which the ink jetting performance is improved.

That is, when ink temperature is comparatively low, because this means that ink viscosity is high, ink viscosity characteristics would tend to cause decrease in jetted ink velocity. However, in the first embodiment, the characteristics of the electromechanical coupling coefficient(s) of the piezoelectric member(s) making up partitions 81*b* tend to cause increase in jetted ink velocity due to the improved efficiency with which electrical energy supplied to partitions 81*b* is converted into mechanical energy for jetting of ink.

Conversely, when ink temperature is comparatively high, because this means that ink viscosity is low, ink viscosity characteristics would tend to cause increase in jetted ink velocity. However, in the first embodiment, the characteristics of the electromechanical coupling coefficient(s) of the piezoelectric member(s) making up partitions 81*b* tend to cause decrease in jetted ink velocity due to the worsened efficiency with which electrical energy supplied to partitions 81*b* is converted into mechanical energy for jetting of ink.

As described above, the effect of ink viscosity characteristics on jetted ink velocity and the effect of electromechanical coupling coefficient characteristic(s) of piezoelectric member(s) making up partitions 81*b* on jetted ink velocity are in directions which tend to cancel one another out. Even where the electrical energy supplied to partitions 81*b* is held constant, it is therefore possible to maintain approximately constant jetted ink velocity through self-correction of conversion efficiency or efficiencies at the partitions 81*b* themselves, permitting improvement in ink jetting performance of inkjet printhead 52.

Note, however, that Japanese Patent Application Publication Kokai No. H9-48113 (1997) discloses an inkjet recording apparatus employing, for preventing reduction in jetting performance due to changes in ink temperature, a piezoelectric member (electromechanical energy converting element) having characteristics such that the rate of change of the electromechanical coupling coefficient with respect to temperature is not more than 3,000 ppm/C.° at least in temperature domains of 20° C. or lower. However, the art disclosed in this publication, being nothing more than designation of a piezoelectric member determined by experiment to have relatively constant ink jetting velocity, cannot be said to be active utilization of a piezoelectric member for which the rate of change of the electromechanical coupling coefficient with respect to temperature exhibits negative characteristics.

In contrast thereto, the structure of the first embodiment actively utilizes, as material(s) making up base plate 81, piezoelectric member(s) for which rate(s) of change with respect to temperature of electromechanical coupling coefficient(s) thereof exhibit negative characteristics, such fact making it possible to maintain approximately constant ink jetting velocity regardless of temperature changes and making it possible to definitively improve ink jetting performance.

Furthermore, in the present color ink jet printer 1, it is preferred that control also be carried out with respect to the electrical energy supplied to partitions 81*b*. As a result, for example through combination with control of voltage(s) applied to drive electrodes 85 provided at partitions 81*b* or other such electrical correction, appropriate correction for maintenance of constant jetted ink velocity will be permitted, making it possible for improved ink jetting performance to be achieved, even where it would not have been possible to maintain completely constant jetted ink velocity as a result only of self-correction of conversion efficiencies of partitions 81*b*. This will consequently make it possible to attain appropriate locations at which ink droplets land on recording paper P, permitting high-quality images to be obtained.

Furthermore, as compared with the situation where electrical correction is carried out alone, combination with self-correction of conversion efficiencies of partitions 81*b* makes it possible to reduce the amount of electrical correction. It is consequently possible to reduce the burden which is placed on the drive circuitry, such as by permitting suppression of drive circuit power consumption, permitting reduction in power supply voltage, and so forth.

First Variation on First Embodiment

Furthermore, as one variation on the first embodiment, the present invention may also be applied to a multidrop-type inkjet printer. That is, for the reasons given below, it will be extremely effective to cause a multidrop-type ink jet printer—wherein a plurality of ink droplets are continuously jetted as a result of causing partition(s) 81*b* comprising piezoelectric member(s) to undergo deformation a plurality of times, these ink droplets combining to form a single dot on recording paper P—to be equipped with partition(s) 81*b* comprising piezoelectric member(s) having electromechanical coupling coefficient(s) exhibiting negative temperature characteristics as described above.

That is, a multidrop-type inkjet printer carries out n times as many ink jetting operations as an inkjet printer that uses a single droplet of ink to jet a single dot onto recording paper P. The increase in temperature of the ink in a multidrop-type inkjet printer due to driving therefore being particularly severe, there will be greater need for temperature correction if ink jetting performance is to be maintained.

Moreover, because the plurality of ink droplets which combine to form a single dot are respectively jetted with different velocities, it is necessary that correction be carried out in correspondence to order of jetting. Furthermore, combined correction in correspondence to jetting order will result in further increase in the amount of correction which is required.

If piezoelectric member(s) having electromechanical coupling coefficient(s) exhibiting negative temperature characteristics is or are used as material(s) making up partitions 81*b*, employment of conversion efficiency self-correction at the partitions 81*b* themselves in such a multidrop-type inkjet printer makes it possible to cause respective ink droplets to be jetted with proper velocities, making it possible to attain satisfactory image quality as formed by respective dots. Furthermore, in such a multidrop-type inkjet printer, it will be possible to reduce the amount of electrical correction, alleviating the burden which is placed on the drive circuitry, where the printer is constituted so as to permit control of electrical energy supplied to partitions 81*b*.

Second Variation on First Embodiment

In addition, the following constitution may be adopted as another variation on the first embodiment of the present invention. To wit, the printer may be constructed such that, taking ink viscosities at ink temperatures Ta (° C.) and Tb (° C.) to respectively be ηa and ηb, taking electrical capacitances of partitions 81*b* (piezoelectric member or members) at those temperatures to respectively be Ca and Cb, taking electromechanical coupling coefficients of partitions 81*b* at those temperatures to respectively be Ka and Kb, and taking voltages supplied so as to cause deformation of partitions 81*b* at those temperatures to respectively be Va and Vb, the supplied voltages are set so as to satisfy $$(Va/Vb)^2=\alpha^2\times(Cb\times Kb^2\times\eta a)/(Ca\times Ka^2\times\eta b)$$

where $0.93\leqq\alpha\leqq1.14$.

Taking the case where jetted ink velocity is 8 m/sec, this will permit the tolerance for jetting velocity deviation to be held within the range from −2 m/sec to +4 m/sec. That is, at 600 dpi (42μ), error in the location at which ink droplets land can be held to ± half the dot pitch (21μ) or lower. This is described in detail below.

Taking the electrical energy input to partitions 81*b* to be Ui, and taking the mechanical energy (strain energy) represented by deformation of partitions 81*b* due to this electrical energy Ui to be Uo, the electromechanical coupling coefficient K is given by the following formula.

$$K=\sqrt{\left\{\frac{(\text{Mechanical energy } Uo)}{(\text{Electrical energy } Ui)}\right\}} \tag{1}$$

Here, taking the strain at partitions 81*b* to be e, and taking Young's modulus for the piezoelectric material thereat to be Y, mechanical energy Uo is given by Formula (2), below.

$$Uo=(1/2)\times Y\times e^2 \tag{2}$$

Taking the dielectric constant of the piezoelectric material to be ϵ, and taking electric field strength to be E, electrical energy Ui is given by Formula (3), below.

$$Ui=(1/2)\times\epsilon\times E^2 \tag{3}$$

Now, piezoelectric constant d, which indicates the strain produced when a voltage is applied to partitions 81*b*, is given by Formula (4), below.

$$d=K\times\sqrt{(\epsilon/Y)} \tag{4}$$

Furthermore, because piezoelectric constant d is the amount of displacement represented by the strain e relative to electric field strength E, this can be rewritten as Formula (5), below.

$$d=e/E \tag{5}$$

Here, taking the square of Formula (4) and substituting Formulas (1) through (3) therein, we have the following:

$$d^2=[\{(1/2)\times Y\times e^2\}/\{(1/2)\times\epsilon\times E^2\}]\times(\epsilon/Y)$$

$$d^2=(e/E)^2 \tag{6}$$

The fact that the formula obtained by taking the square of Formula (5) is the same as Formula (6) serves as a check on the correctness of Formulas (1) through (5).

By therefore using Formulas (1) through (5), and letting V represent the voltage applied to partitions 81*b* and letting C represent the electrical capacitance of the piezoelectric material when electrical energy is input into partitions 81*b*, the mechanical energy Uo which is output by the piezoelectric material relative to the input thereat is given by Formula (7), below.

$$Uo=K^2\times(1/2)\times C\times V^2 \tag{7}$$

Figure 11:
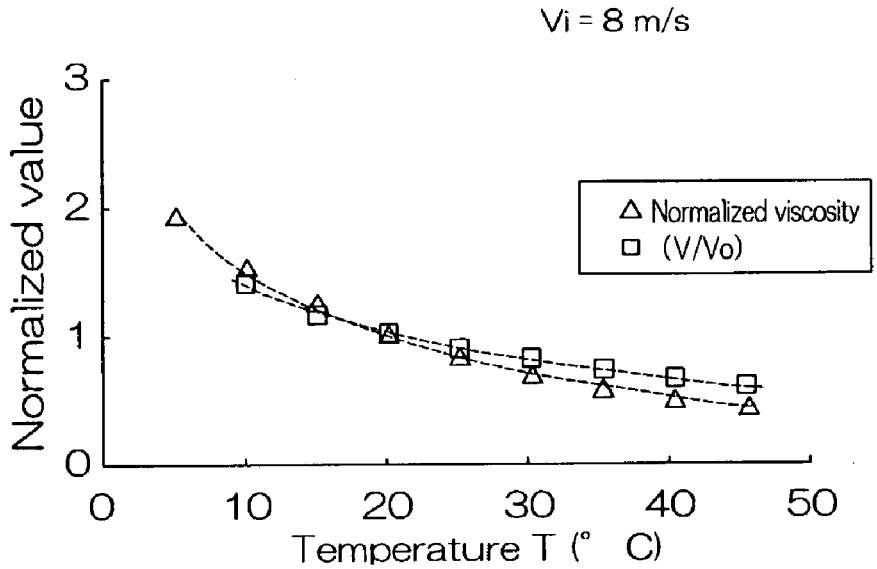
FIG. 11 is a drawing showing the relationship between ink temperature and ink viscosity, and the relationship between ink temperature and the voltage which must be applied in order to maintain a constant jetted ink droplet velocity of 8 m/sec, normalized values being respectively shown.

FIG. 11 shows graphs respectively indicating in normalized fashion the relationship between ink temperature and ink viscosity η, and the relationship between ink temperature and the voltage which must be applied in order to maintain a constant jetted ink droplet velocity of 8 m/sec.

At this FIG. 11, viscosity is shown normalized relative to viscosity when ink temperature is 20° C. Furthermore, applied voltage is indicated by the value $(V/Vo)^2$, this being the square of the respective applied voltages ($V^2$) as normalized relative to the square of the applied voltage when ink temperature is 20° C. ($Vo^2$). Here, based on Formula (7), the value $(V/Vo)^2$ can be understood to represent the normalized mechanical energy Uo.

From FIG. 11, it is clear that there is a correlation between the ink temperature-mechanical energy Uo relationship and the ink temperature-ink viscosity relationship.

Here, taking ink viscosities at ink temperatures Ta (° C.) and Tb (° C.) to respectively be ηa and ηb, taking electrical capacitances of partitions 81*b* at those temperatures to respectively be Ca and Cb, taking electromechanical coupling coefficients of partitions 81*b* at those temperatures to respectively be Ka and Kb, and taking voltages supplied so as to cause deformation of partitions 81*b* at those temperatures to respectively be Va and Vb, it is possible to obtain Formula (8), below, from FIG. 11 and Formula (7).

$$(Va/Vb)^2=\alpha^2\times(Cb\times Kb^2\times\eta a)/(Ca\times Ka^2\times\eta b) \tag{8}$$

That is, in order to maintain constant jetted ink velocity at color inkjet printer 1, applied voltage should be varied so as to satisfy Formula (8).

Here, normalized tolerance α at Formula (8) should be within the range $0.93\leqq\alpha\leqq1.14$ for the reasons given below.

Taking length on the paper surface to be L=1 mm, taking jetted ink velocity to be Vi=8 m/sec, taking jetting cycles to be 300 dpi (dots per inch)×6000 pps (pulse per sec), and assuming a 600 dpi image printed in two passes, now since 1 inch is 25.4 mm, dot pitch Xp is given by $$Xp=25.4\text{ mm}\div 600=42\ \mu\text{m},$$

carriage velocity Vc is given by $$Vc=(25.4\text{ mm}\div 300)\times 6000=508\text{ mm/sec}$$

and dot placement accuracy is given by

±(Xp/2)=21 μm. Furthermore, the tolerance for jetted velocity deviation ΔVi may be expressed by the following formula.

$$\Delta Vi=(Vi^2\times\Delta X)/(L\times Vc-Vi\times\Delta X) \quad (9)$$

Since ΔX is ±21μ, Vc is 508 mm/sec, and L is 1 mm, then from Formula (9), the following can be obtained.

$$\Delta Vi=-2.0\text{ m/sec}$$

$$\Delta Vi=+4.0\text{ m/sec} \quad (10)$$

Figure 12:
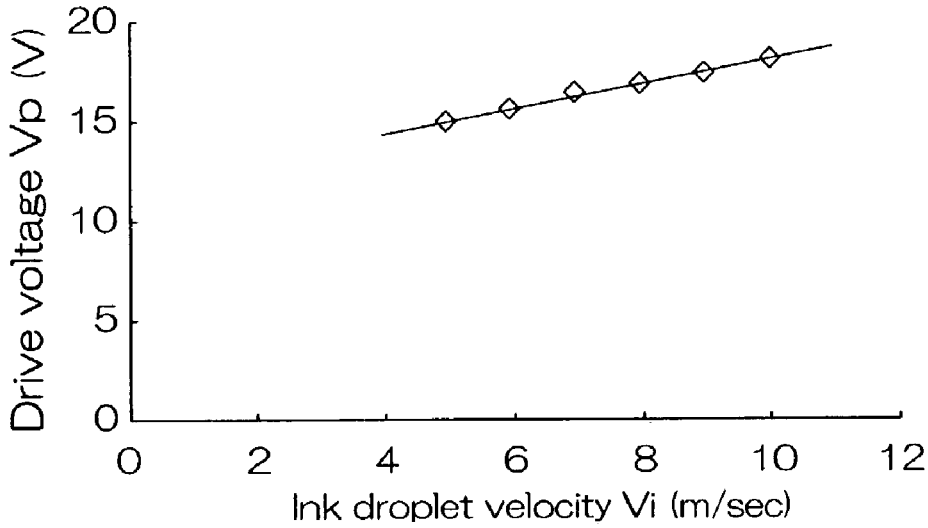
FIG. 12 is a drawing showing the relationship between jetted ink droplet velocity and applied drive voltage.

On the other hand, FIG. 12 shows voltages Vp which must be applied to partitions 81*b* to obtain respective jetted ink velocities. Based on same FIG., applied voltage Vp and jetted ink droplet velocity Vi are directly proportional to one another—the notion that applied voltage Vp and jetted ink droplet velocity Vi should be directly proportional to one another also being reasonable based upon consideration of the fact that the electrical energy input to inkjet printhead 52 is a second-order function of applied voltage Vp; the energy consumed due to fluid resistance at the nozzles is a function of the bulk velocity of the ink at the nozzles, i.e., a second-order function of jetted ink droplet velocity; the energy dissipated from the printhead to the exterior is the energy of motion of the ink droplets, energy of motion being a second-order function of jetted ink droplet velocity Vi; all of these being second-order functions—which can be expressed by the following formula.

$$Vp=0.586\times Vi+12.2$$

Normalized tolerance a is therefore such that $$0.93\leqq\alpha\leqq 1.14. \quad (11)$$

Based on the foregoing relationship between input electrical energy and output mechanical energy, by setting the voltage which is applied at drive electrodes 85 so as to satisfy Formula (8) and Formula (11) it is possible at color inkjet printer 1, taking the case where jetted ink velocity is 8 m/sec, to hold the tolerance for jetting velocity deviation to be held within the range from −2 m/sec to +4 m/sec. That is, at 600 dpi (42μ), error in the location at which ink droplets land can be held to ± half the dot pitch (21μ) or lower.

Second Embodiment

Color inkjet printer 1 associated with a second embodiment of the present invention employs, as piezoelectric member(s) making up base plate 81 of inkjet printhead 52 (see FIG. 4), piezoelectric member(s) for which electromechanical coupling coefficient(s) thereof exhibit positive characteristics with respect to temperature. Note that since the constitution and operation of color inkjet printer 1 share many features in common with the first embodiment, those aspects which are different from the first embodiment will be described below.

Figure 13:
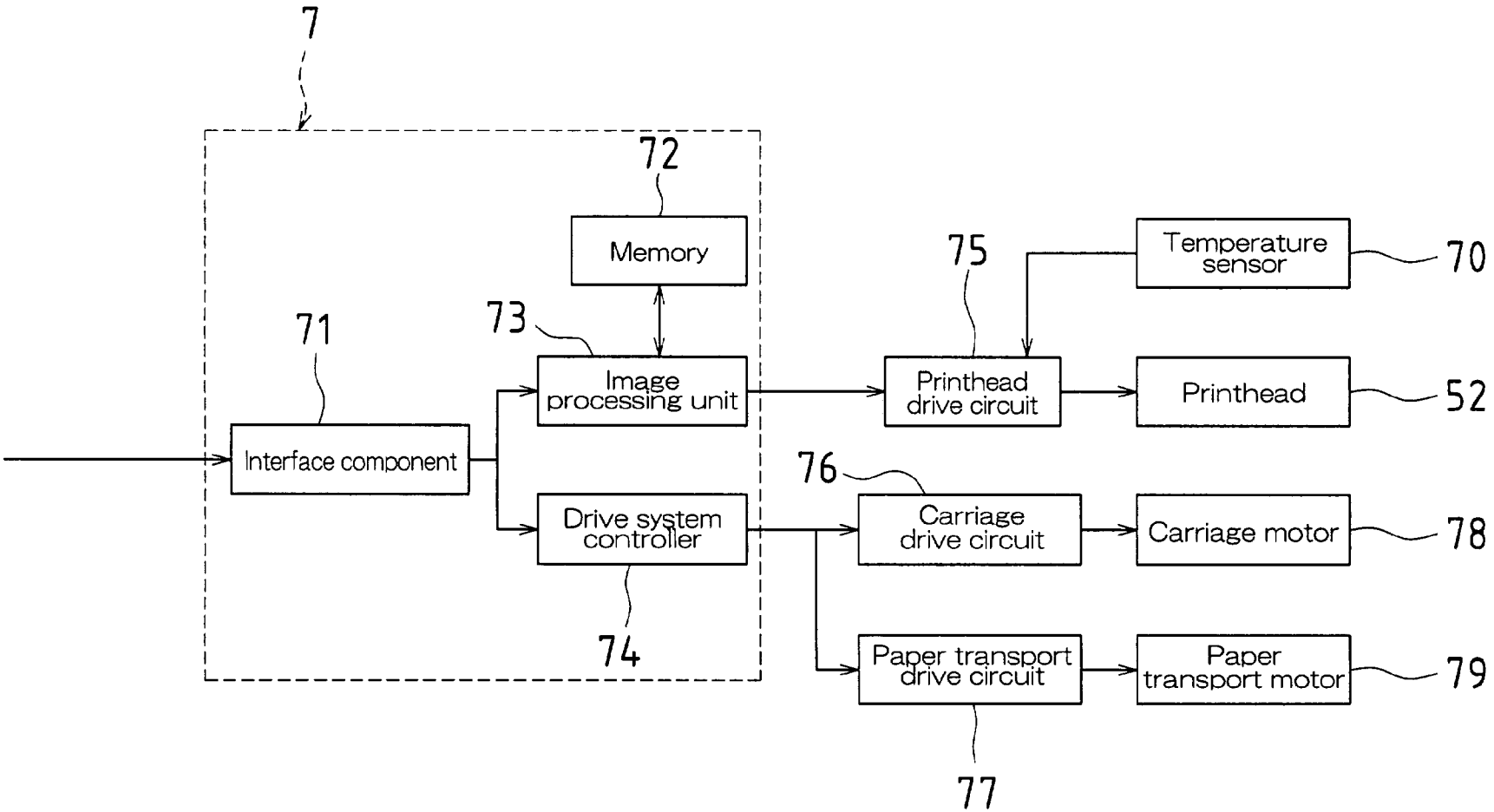
FIG. 13 is a block diagram showing the constitution of a controller for a color inkjet printer associated with a second embodiment of the present invention.

FIG. 13 is a block diagram showing the constitution of a controller 7 for a color inkjet printer 1 associated with a second embodiment of the present invention. What is different from controller 7 of the first embodiment (see FIG. 3) is that inkjet printhead 52 is provided with temperature sensor 70, this temperature sensor 70 being connected to printhead drive circuit 75. This permits temperature information detected by this temperature sensor 70 to be sent to printhead drive circuit 75, and permits printhead drive circuit 75 to control voltage(s) applied to piezoelectric member(s) making up base plate 81 of inkjet printhead 52 as appropriate based on this temperature information and image data from image processing unit 73.

As shown in FIG. 16, the viscosity η of the ink jetted from inkjet printhead 52 exhibits negative characteristics, meaning that the value thereof decreases with increasing ink temperature. Accordingly, in order to maintain constant jetted ink velocity regardless of changes in temperature, it will be necessary, as ink temperature increases, to decrease the mechanical energy stored in the piezoelectric member responsible for jetting of ink. Stated differently, as the temperature of the piezoelectric member(s) rises—this representing one factor responsible for increase in ink temperature—it will become increasingly possible to reduce the aforementioned mechanical energy if it is sufficient that jetted ink velocity be maintained at a constant value.

Furthermore, if piezoelectric member(s) for which rate(s) of change of electromechanical coupling coefficient(s) exhibit positive temperature characteristics as indicated at FIG. 6 is or are employed, the efficiency with which electrical energy supplied to piezoelectric member(s) is converted into mechanical energy will increase as the temperature of piezoelectric member(s) increases. As a result, jetted ink velocity will increase further due to the piezoelectric member(s) itself or themselves. If jetted ink velocity is held constant, it will consequently be possible to further decrease the mechanical energy stored at the piezoelectric member(s) by a corresponding amount.

If the electrical energy which is supplied to the piezoelectric member(s) is held constant, the aforementioned relationship with respect to change in temperature of ink at the piezoelectric member(s) and ink viscosity will be as stated below.

When ink temperature is comparatively low, the fact that ink viscosity is high means that the viscosity characteristics of the ink cause the velocity at which ink is jetted to decrease. Moreover, the characteristics of the electromechanical coupling coefficient(s) of the piezoelectric member(s) are such as to cause further decrease in jetted ink velocity due to the worsened efficiency with which electrical energy supplied to piezoelectric member(s) is converted into mechanical energy for jetting of ink.

On the other hand, when ink temperature is comparatively high, the fact that ink viscosity is low means that the viscosity characteristics of the ink cause the velocity at which ink is jetted to increase. Moreover, the characteristics of the electromechanical coupling coefficient(s) of the piezoelectric member(s) are such as to cause further increase in jetted ink velocity due to the improved efficiency with which electrical energy supplied to piezoelectric member(s) is converted into mechanical energy for jetting of ink as temperature increases.

That is, when jetted ink velocity—viewed as a function which varies in accordance with ink viscosity characteristics—increases, jetted ink velocity—viewed as a function which varies in accordance with piezoelectric member electromechanical coupling coefficient characteristics—also increases. Accordingly, employment of piezoelectric member(s) associated with the present embodiment, for which rate(s) of change of electromechanical coupling coefficient(s) exhibit positive temperature characteristics, will make it possible, under circumstances where jetted ink velocity is held constant, to decrease the electrical energy which is supplied to piezoelectric member(s) still further, beyond amounts attributable to the effect of ink viscosity characteristics. This will make it possible to even further decrease the amount of heat generated by piezoelectric member(s).

Taking the electrical energy input to piezoelectric member(s) to be Ui, and taking the mechanical energy (strain energy) for deformation of piezoelectric member(s) which is converted from electrical energy Ui to be Uo, the electromechanical coupling coefficient K is given by the following formula.

$$K = \sqrt{\left\{\frac{(\text{Mechanical energy } Uo)}{(\text{Electrical energy } Ui)}\right\}} \tag{12}$$

Here, taking piezoelectric member strain to be e and Young's modulus to be Y, mechanical energy Uo is given by Formula (13).

$$Uo=(1/2)\times Y\times e^2 \tag{13}$$

Taking piezoelectric member dielectric constant to be $\epsilon$ and electric field strength to be E, electrical energy Ui is given by Formula (14).

$$Ui=(1/2)\times\epsilon\times E^2 \tag{14}$$

Now, piezoelectric constant d, which indicates the strain produced when a voltage is applied to piezoelectric member(s), is given by Formula 15.

$$d=K\times\sqrt{(\epsilon/Y)} \tag{15}$$

Furthermore, because piezoelectric constant d is the amount of displacement represented by strain e relative to electric field strength E, this can be rewritten as Formula (16).

$$d=e/E \tag{16}$$

Here, taking the square of Formula (15) and substituting Formulas (12) through (14) therein, we have the following:

$$d^2=[\{(1/2)\times Y\times e^2\}/\{(1/2)\times\epsilon\times E^2\}]\times(\epsilon/Y)$$

$$\therefore d^2=(e/E)^2 \tag{17}$$

The fact that the formula obtained by taking the square of Formula (16) is the same as Formula (17) serves as a check on the correctness of Formulas (12) through (16). Accordingly, expressing the electrical energy Ui input to piezoelectric member(s) in terms of electrical capacitance C of piezoelectric member(s) and voltage V applied to piezoelectric member(s), and using Formulas (12) through (16), the mechanical energy Uo responsible for deformation of piezoelectric member(s) relative to electrical energy Ui is given by Formula (18).

$$Uo=K^2\times(1/2)\times C\times V^2 \tag{18}$$

Here, electrical capacitances of piezoelectric member(s) at ink temperatures Ta (° C.) and Tb (° C.) are respectively taken to be Ca and Cb, electromechanical coupling coefficients of piezoelectric member(s) at those temperatures are respectively taken to be Ka and Kb, and voltages supplied so as to cause deformation of piezoelectric member(s) at those temperatures are respectively taken to be Va and Vb. Using Formula (18) to calculate the conditions for which the mechanical energy causing deformation of piezoelectric member(s) is the same for both ink temperatures Ta (° C.) and Tb (° C.), Formula (19), below, is obtained.

$$Vb^2=(Ca/Cb)\times(Ka/Kb)^2\times Va^2 \tag{19}$$

Figure 14:
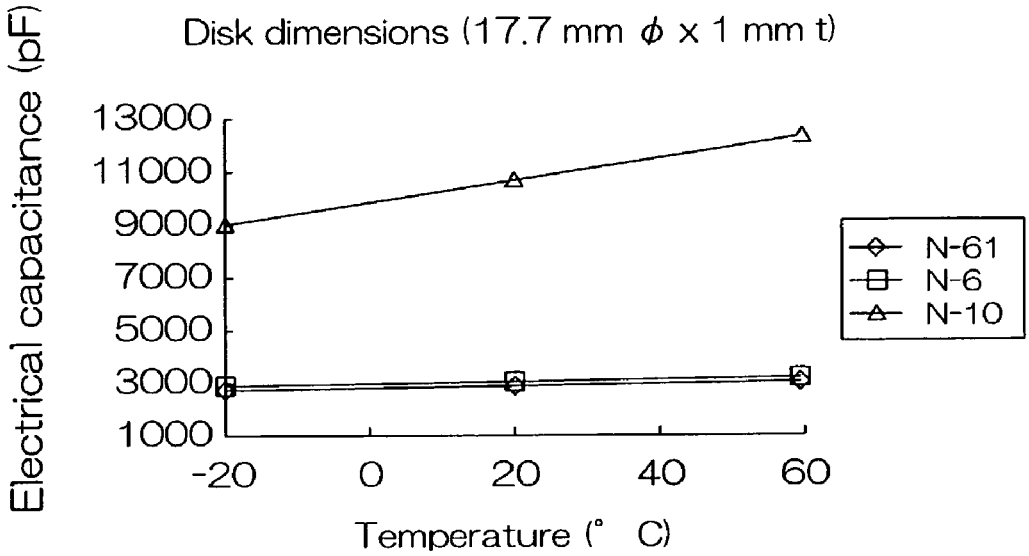
FIG. 14 is a block diagram showing temperature characteristics of electrical capacitance for a typical piezoelectric member (disc form).
Figure 15:
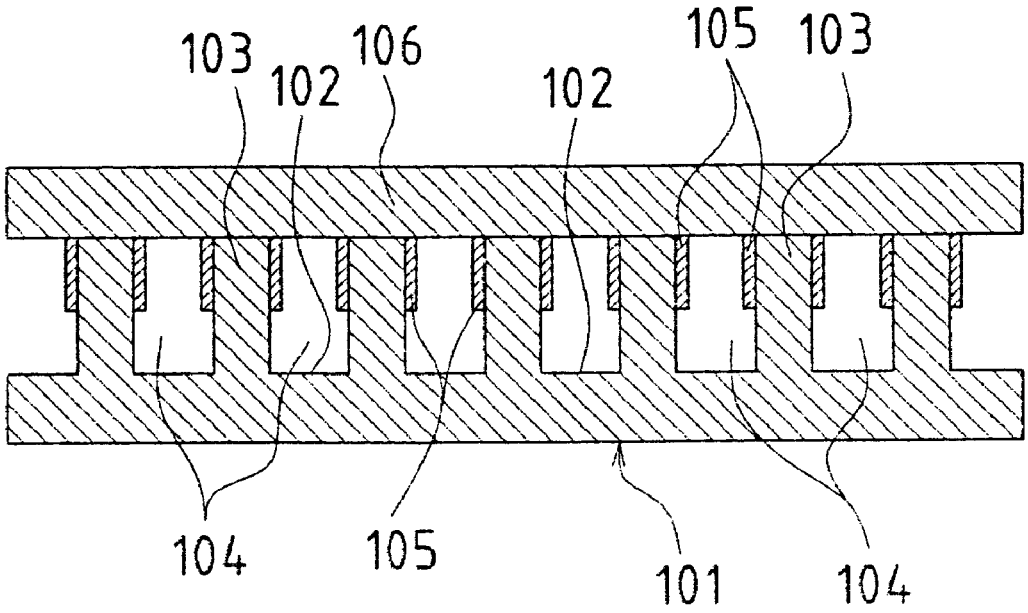
FIG.15 CONVENTIONAL ART
FIG. 15 is a sectional diagram of a conventional example of an inkjet printhead, shown as viewed from the ink jetting direction.

Furthermore, electrical capacitance of a typical piezoelectric member exhibits positive characteristics, increasing with increasing temperature, as shown at FIG. 14.

Under conditions where the mechanical energy output by a piezoelectric member is to be held constant, it is obvious from Formula (19) that the change in electrical capacitance of the piezoelectric member as a function of temperature will affect the voltage which must be applied to the piezoelectric member. However, the amount of heat generated by the piezoelectric member, expressed in terms of the electrical capacitance C of the piezoelectric member and the voltage V applied to the piezoelectric member, will be proportional to $C\times V^2$. Accordingly, using Formula (19) to calculate the amount of heat generated thereby, the change in electrical capacitance itself and the change in applied voltage accompanying the change in electrical capacitance due to change in temperature of the piezoelectric member canceling one another out so as to have no net effect on the amount of heat generated, the amount of heat generated will be affected only by the change in electromechanical coupling coefficient.

Therefore, in order to consider only the effect of electromechanical coupling coefficient, Ca will be hereafter be set equal to Cb when using Formula (19).

Here, calculation is carried out using piezoelectric member N-10 at FIG. 6, for which the rate of change of the electromechanical coupling coefficient exhibits positive characteristics with respect to temperature. As indicated at FIG. 6, the electromechanical coupling coefficient at 20° C. is 0.68, and the electromechanical coupling coefficient at 60° C. is 0.71. Accordingly, this means that the voltage which is applied to the piezoelectric member at 60° C. need only be $$(0.68/0.71)\times 100=95.8(\%)$$

of the voltage which is applied thereto at 20° C. Moreover, because the amount of heat generated by the piezoelectric member is proportional to $C\times V^2$, the amount of heat generated at 60° C. can be held to $$(0.68/0.71)^2\times 100=91.7(\%)$$

of the amount of heat generated thereby at 20° C.

Performing similar calculations using piezoelectric member N-61 at FIG. 6, for which the rate of change of the electromechanical coupling coefficient exhibits negative characteristics with respect to temperature, as indicated at FIG. 6 the electromechanical coupling coefficient at 20° C. is 0.635 and the electromechanical coupling coefficient at 60° C. is 0.62. Accordingly, this means that the voltage which is applied to the piezoelectric member at 60° C. must be $$(0.635/0.62)\times 100=102.4(\%)$$

of the voltage which is applied thereto at 20° C. Moreover, the amount of heat generated at 60° C. will increase to $$(0.635/0.62)^2\times 100=104.9(\%)$$

of the amount of heat generated thereby at 20° C.

The foregoing sample calculations demonstrate that provision of a piezoelectric member for which the rate of change of the electromechanical coupling coefficient exhibits positive characteristics with respect to temperature will make it possible to suppress the amount of heat generated by the piezoelectric member.

As described above, as a result of causing the walls of ink chambers 84 which jet ink to be made up of piezoelectric member(s) for which rate(s) of change of electromechanical coupling coefficient(s) exhibit positive characteristics with respect to temperature, and as a result of using printhead drive circuit 75, serving as control means in the present invention, to control the electrical energy to be supplied to piezoelectric member(s) during jetting of ink based on image data and temperature information detected by temperature sensor 70 provided at the inkjet printhead, electromechanical coupling coefficient(s) of piezoelectric member(s) increase with increasing temperature, permitting electrical energy which is supplied to piezoelectric member(s) to be efficiently converted into mechanical energy, and reducing the amount of electrical energy required for jetting of ink through mechanical deformation of piezoelectric member(s) and lowering voltage(s) applied to piezoelectric member(s).

Furthermore, as temperature increases, decrease in ink viscosity makes it easier to jet ink, further reducing the amount of electrical energy required for jetting of ink and permitting further reduction in voltage(s) applied to piezoelectric member(s). Because the decrease in applied voltage accompanying a rise in temperature of the ink and the piezoelectric member(s) makes it possible to prevent marked increase in the amount of heat generated by the piezoelectric member(s) itself or themselves in accompaniment to the rise in temperature, the range over which the temperature of the ink, the piezoelectric member(s), and the surrounding circuitry fluctuates can be reduced. It is therefore possible to reduce the range over which ink viscosity varies, and since correction of voltage(s) can be carried out more accurately, it is possible to carry out temperature compensation in more stable fashion, permitting achievement of stable ink jetting performance.

Moreover, because the effect on characteristics and longevity of piezoelectric member(s) and surrounding circuitry caused by variation in temperature can be reduced, attainment of increased longevity and stabilization of characteristics is permitted.

Furthermore, while a multidrop-type inkjet image forming apparatus—wherein a plurality of ink droplets are jetted as a result of causing piezoelectric member(s) to undergo deformation a plurality of times in succession, these ink droplets combining to form a single dot on the paper surface as image formation is carried out—might supply electrical energy to piezoelectric member(s) more times than a single-drop-type inkjet image forming apparatus which carries out image formation using a single droplet of ink per dot, might—due to the different respective velocities with which the plurality of ink droplets are jetted—carry out correction of applied voltage with respect to temperature more times than such a single-drop-type inkjet image forming apparatus, and might experience more severe temperature fluctuations than such a single-drop-type inkjet image forming apparatus, provision of piezoelectric member(s) exhibiting positive characteristics in rate(s) of change of electromechanical coupling coefficient(s) with respect to temperature will make it possible to prevent marked increase in temperature of ink, piezoelectric member(s), and surrounding circuitry and will make it possible to more accurately carry out correction of applied voltage with respect to temperature in correspondence to the respective jetted velocities of the plurality of consecutively jetted ink droplets. Accordingly, it is possible to more effectively achieve stable ink jetting performance.

Other Applications of First Embodiment and Second Embodiment

Whereas the foregoing first embodiment and second embodiment have been described in terms of application of the present invention to a color inkjet printer 1, it is also possible to apply the present invention to a monochrome-type inkjet printer.

Furthermore, the present invention is not limited to serial-type inkjet printers in which image forming operations are carried out as carriage 51 is scanned in a scan direction, but may also be applied to line-type inkjet printers which do not employ such scanning action.

Moreover, lithium niobate, lithium tantalite, and/or the like may also be employed as the piezoelectric material making up base plate 81 of the first embodiment.

The present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are moreover within the scope of the present invention.

Moreover, the present application claims right of benefit of prior filing dates of Japanese Patent Application No. 2002-171673 and Japanese Patent Application No. 2002-173310, the content of both of which is incorporated herein by reference in its entirety. Furthermore, all references cited in the present specification are specifically incorporated herein by reference in their entirety.

What is claimed is:

1. An inkjet printhead wherein electrical energy is supplied to at least one piezoelectric member making up at least one wall of at least one ink chamber, causing deformation of the at least one piezoelectric member, as a result of which at least a portion of the ink within at least one of the ink chamber is jetted toward at least one recording medium, comprising:

an inkjet printhead that has at least one rate of change with respect to temperature, of at least one electromechanical coupling coefficients of the piezoelectric member, said rate of change exhibiting negative characteristics, wherein the inkjet printhead is constructed so as to permit control of at least a portion of the electrical energy supplied to the at least one piezoelectric member and the electrical energy supplied is based solely on the change of temperature.

2. The inkjet image forming apparatus employing at least one inkjet printhead according to claim 1 and wherein ink droplets are jetted toward at least one recording medium from at least one ink chamber of at least one of the inkjet printhead so as to form at least one image on at least one surface of the at least one recording medium.

3. An inkjet printhead wherein electrical energy is supplied to at least one piezoelectric member making up at least one wall of at least one ink chamber, causing deformation of the at least one piezoelectric member and permitting a plurality of consecutively jetted ink droplets to be made to combine to form a single dot on recording medium, comprising:

the inkjet printhead that has at least one rate of change with respect to temperature, of at least one electromechanical coupling coefficients of the piezoelectric member, said rate of change exhibits negative characteristics, wherein the inkjet printhead is constructed so as to permit control of at least a portion of the electrical energy supplied to the at least one piezoelectric member and the electric energy supplied is based solely on the change of temperature.

4. The inkjet image forming apparatus employing at least one inkjet printhead according to claim 3 and wherein ink droplets are jetted toward at least one recording medium from at least one ink chamber of at least one of the inkjet printhead so as to form at least one image on at least one surface of the at least one recording medium.

5. An inkjet printhead wherein electrical energy is supplied to at least one piezoelectric member making up at least one wall of one ink chamber, causing deformation of the at least one piezoelectric member, as a result of which at least a portion of the ink within at least one of the ink chamber is jetted toward at least one recording medium, including an inkjet printhead that is constructed such that, taking ink viscosities at ink temperatures Ta (° C.) and Tb (° C.) to respectively be ηa and ηb, taking electrical capacitances of the at least one piezoelectric member at those temperatures to respectively be Ca and Cb, taking electromechanical coupling coefficients of the piezoelectric member at those temperatures to respectively be Ka and Kb, and taking voltages supplied so as to cause deformation of at least one of the piezoelectric member at those temperatures to respectively be Va and Vb, the supplied voltages are set so as to satisfy $$(Va/Vb)^2=\alpha^2\times(Cb\times Kb^2\times\eta a)/(Ca\times Ka^2\times\eta b)$$

where $0.93\leqq\alpha\leqq1.14$.

6. The inkjet image forming apparatus employing at least one inkjet printhead according to claim 5 and wherein ink droplets are jetted toward at least one recording medium from at least one ink chamber of at least one of the inkjet printhead so as to form at least one image on at least one surface of the at least one recording medium.

7. An inkjet image forming apparatus equipped with one or more inkjet printheads wherein electrical energy is supplied to one or more piezoelectric members making up at least one wall of one or more ink chambers, causing deformation of at least one of the piezoelectric member or members, as a result of which at least a portion of the ink within the at least one or more of the ink chamber or chambers is jetted toward one or more recording media, the inkjet image forming apparatus including one or more means for controlling at least a portion of the electrical energy supplied to at least one of the piezoelectric member or members based on image data and ink temperature; and one or more rates of change with respect to temperature, of one or more electromechanical coupling coefficients of the piezoelectric member or members, exhibits positive characteristics.

8. An inkjet image forming apparatus according to claim 7 characterized in that at least one of the control means permits the number of times electrical energy is supplied per dot to be varied in correspondence to image density.

9. An inkjet image forming apparatus equipped with one or more inkjet printheads wherein electrical energy is supplied to one or more piezoelectric members making up at least one wall of one or more ink chambers, causing deformation of at least one of the piezoelectric member or members, as a result of which at least a portion of the ink within at least one of the ink chamber or chambers is jetted toward one or more recording media, comprising:

the inkjet image forming apparatus that has one or more controllers for controlling at least a portion of the electrical energy supplied to at least one of the piezoelectric member or members based on image data and ink temperature; and one or more rates of change with respect to temperature, of one or more electromechanical coupling coefficients of the piezoelectric member or members, exhibiting positive characteristics.

10. The inkjet image forming apparatus according to claim 9 wherein the at least one of the controllers permits the number of times electrical energy is supplied per dot to be varied in correspondence to image density.

* * * * *